US012110701B2

(12) United States Patent
Pierman

(10) Patent No.: US 12,110,701 B2
(45) Date of Patent: Oct. 8, 2024

(54) DECK UMBRELLA SUPPORT SYSTEM

(71) Applicant: Blake Pierman, Bath Township, MI (US)

(72) Inventor: Blake Pierman, Bath Township, MI (US)

(73) Assignee: BRP VENTURES, L.L.C., Bath, MI (US)

( * ) Notice: Subject to any disclaimer, the term of this patent is extended or adjusted under 35 U.S.C. 154(b) by 79 days.

(21) Appl. No.: 17/722,767

(22) Filed: Apr. 18, 2022

(65) Prior Publication Data

US 2022/0333398 A1 Oct. 20, 2022

Related U.S. Application Data

(60) Provisional application No. 63/176,788, filed on Apr. 19, 2021.

(51) Int. Cl.

| | |
|---|---|
| ***E04H 12/22*** | (2006.01) |
| *A45B 11/00* | (2006.01) |
| *A45B 23/00* | (2006.01) |

(52) U.S. Cl.

CPC ..... *E04H 12/2269* (2013.01); *A45B 11/00* (2013.01); *A45B 23/00* (2013.01); *A45B 2023/0012* (2013.01)

(58) Field of Classification Search

CPC ..... F16B 21/04; A45B 2023/0012; A45B 2023/0025; A45B 23/00; E04H 12/2269; A47B 11/00

(Continued)

(56) References Cited

U.S. PATENT DOCUMENTS 2,859,840 A * 11/1958 Fantle ..... E04H 12/32 52/297
3,391,515 A * 7/1968 Clay ..... E04B 1/415 52/709

(Continued)

FOREIGN PATENT DOCUMENTS

AU 2018253604 A1 * 5/2020 ..... E04H 12/2269
DE 10344796 B3 * 6/2005 ..... F16B 21/04

(Continued)

OTHER PUBLICATIONS

"Pilot Rock Patio Buddy." Amazon.Com, 2022, www.amazon.com/Pilot-Rock-Patio-Buddy-Removable/dp/B0BKR7YYDK. (Year: 2022).*

*Primary Examiner* — Taylor Morris
(74) *Attorney, Agent, or Firm* — NKL Law; Jae Youn Kim

(57) ABSTRACT

A deck umbrella support system securely retains an umbrella attached to an umbrella pole on a deck, wherein the deck has a receiving aperture formed through a surface thereof. The deck umbrella support system may include a mount assembly having a mount tube with a mount plate attached to it. The mount tube has an upper end and a lower end, wherein the upper end includes a mount aperture formed through it. An adapter assembly, which is at least partially hollow, includes an adapter tube which is designed and configured to receive at least a portion of the umbrella pole therein and to be inserted into the mount tube via the mount aperture. A locking assembly is disposed proximate to the lower end of the mount tube to secure the adapter tube in the mount tube.

18 Claims, 17 Drawing Sheets

(58) Field of Classification Search
USPC ..... 248/539
See application file for complete search history.

(56) References Cited

U.S. PATENT DOCUMENTS 4,011,881 A * 3/1977 Becher ..... E04B 1/3441 135/33.4
4,582,287 A * 4/1986 DeLeary ..... A47B 37/04 248/539
5,685,517 A * 11/1997 Salibra ..... A01K 97/10 248/539
5,687,946 A * 11/1997 Cho ..... A45B 11/00 248/533
6,328,285 B1 * 12/2001 Wiseman ..... E04H 12/2269 256/67
6,574,924 B2 * 6/2003 Maniezzo ..... A47F 5/0823 52/36.5
7,150,579 B2 * 12/2006 Newton ..... E01F 9/685 403/372
7,614,600 B1 * 11/2009 Smith ..... G09F 23/00 248/910
7,694,487 B1 * 4/2010 Ryan ..... E04H 12/2269 52/297
8,540,198 B2 * 9/2013 Keyvanloo ..... A47B 96/061 248/220.21
9,212,501 B2 * 12/2015 Walker ..... E04H 12/347
9,629,427 B1 * 4/2017 Alm ..... A45B 25/00
9,657,493 B2 * 5/2017 Finnegan ..... E04H 12/2215
10,492,377 B2 * 12/2019 Volin ..... E04H 12/2246
2009/0229200 A1 * 9/2009 Noble ..... H02S 20/10 248/176.1
2009/0314910 A1 * 12/2009 Jeanveau ..... E04H 12/2261 248/231.71
2012/0132779 A1 * 5/2012 Johnson ..... E04H 12/2269 248/513
2018/0142481 A1 * 5/2018 Gurtler ..... A62B 35/0068
2019/0360229 A1 * 11/2019 Vanderminden ..... A45B 23/00

FOREIGN PATENT DOCUMENTS

DE 102004022389 A1 * 12/2005 ..... F16B 21/04
GB 2234766 A * 2/1991 ..... E01F 13/024

* cited by examiner

DECK UMBRELLA SUPPORT SYSTEM

CROSS-REFERENCE TO RELATED APPLICATION(S)

The present application claims benefit and priority to U.S. provisional patent application No. 63/176,788 filed on Apr. 19, 2021, the disclosure of which is hereby incorporated by reference in its entirety.

FIELD OF THE INVENTION

The present invention relates generally to an umbrella support system, and more particularly, to a deck umbrella support system.

BACKGROUND OF THE INVENTION

It is no secret that Americans love the outdoors. In particular, the outdoor spaces adjacent where we live and/or work where backyard pool parties and barbeques are commonplace across the country during the summer months, and year round in warmer climates. Such outdoor events are especially widespread during the summer holidays and weekends.

As such, it is also a fairly common practice for many homes, apartment complexes, and/or recreational spaces, both public and private, to include some form of decking on which to hold at least some aspects of such outdoor events, so as to avoid excessive wear and tear on the lawns and other landscaping in areas where pool parties and/or barbeques occur. It is also very common for one or more umbrellas to be positioned on such a deck to provide shade and/or cover from the elements, such as wind and rain, for the host and guests of the pool party, barbeque, etc.

In order to support an umbrella or umbrellas on a deck, wherein an umbrella as used herein includes interchangeably, an umbrella canopy, the umbrella is attached to an umbrella pole and the umbrella, i.e., the umbrella canopy, is positioned in a suitable operative location above a portion of the deck so as to maximize the shade or cover provided to the persons, and perhaps pets, occupying the deck.

In order to maintain an umbrella in position on a deck, as well as elsewhere, some form of an umbrella base is typically employed. The types of umbrella bases commonly in use today consist of a variety of round or square or other shape solid metal, or similar such material, having a short, i.e., several inches or so in length, retention tube extending upwardly from the base to receive the distal portion of an umbrella pole therein. One or more set screws or similar fastening means are typically provided for a user to utilize to secure the umbrella, attached to an umbrella pole, to the base. As anyone who has ever tried to secure an outdoor umbrella of any size in such a base knows, it is nearly impossible to secure an outdoor umbrella to such a base in a manner that provides any substantial form of stability. More often than not, the slightest wind or rain is enough to cause an umbrella or umbrella canopy to spin, twist, tilt or even topple. Not only does this negate the purpose of the umbrella in the first place, namely, to provide cover, but a spinning, twisting, tilting or toppling outdoor umbrella can do significant damage to persons, food, drinks, furniture, pets, etc., that are present on the deck at the time, as well as doing potentially costly damage to the deck itself.

Furthermore, outdoor umbrellas can be somewhat significant investments, easily several hundred dollars each for a decent sized outdoor umbrella of even basic quality materials of construction. As such, the potential damage to an outdoor umbrella itself due to spinning, twisting, tilting or toppling can be damaging, economically, to the umbrella owner.

One attempt to provide greater stability for umbrellas staged outdoors, such as on a deck, and the now almost ubiquitous bulky round umbrella bases which are fillable with water or sand to provide more weight than the typical metal type bases described above. These large bulky bases are intrusive, and can often compete for the very deck space they are intended to protect while in use, and often become a nuisance and potential trip hazard when not in use, i.e., when an umbrella is not mounted in the base. Unfortunately, even with a larger footprint and/or additional weight, these types of outdoor umbrella bases still allow an umbrella or umbrella canopy to spin, twist, tilt or even topple in even moderate wind and rain, thus, leading to all of the problems noted above and encountered with the smaller metal type umbrella bases.

A further, more recent approach has been to employ large multi-member outdoor umbrella supports that include large footprints that may be cross or H-shaped, and that may include numerous cross-bars and/or pole supports. Such multi-member outdoor umbrella supports also often include complex, and expensive, attachment and operational components for staging, opening, and closing an outdoor umbrella. Thus, the stability benefits provided by such large multi-member outdoor umbrella supports are heavily outweighed by the spatial/footprint requirements, the complexity of design and operation, and, of course, the considerable expense.

Accordingly, there is an established need for a solution to one or more of the aforementioned problems.

SUMMARY OF THE INVENTION

The present invention is generally directed to an umbrella support system.

In an aspect of the present invention, an umbrella support system to securely retain an umbrella canopy attached to an umbrella pole on a deck or an underlying substrate may include: a mount assembly including a mount tube and a mount plate attached to the mount tube, the mount tube having a mount aperture disposed at an upper end thereof and at least partially hollow interior and the mount plate may be configured to secure the umbrella support system to the deck or the underlying substrate; an adapter assembly including an adapter tube having an at least partially hollow interior, and the adapter tube may be configured to receive at least a portion of the umbrella pole to the at least partially hollow interior of the adapter tube and at least a portion of the adapter tube may be configured to be inserted into the mount aperture of the mount tube; and a locking assembly disposed proximate a lower end of the mount tube and configured to secure the adapter tube in the mount tube in a locking orientation.

In another aspect, the mount tube may include a locking protrusion disposed on the interior of the mount tube and protruding inwards, and the adapter tube may include a locking channel disposed at a lower end thereof and may be configured to allow the locking protrusion to move therethrough in and out of the locking orientation.

In yet another aspect, the locking channel may include a locking protrusion release channel and a locking protrusion retention channel in communication with the locking protrusion release channel, the locking protrusion retention channel may be disposed to be substantially perpendicular to the locking protrusion release channel, the locking protrusion release channel may be substantially parallel to an axial direction of the adapter tube, and the locking protrusion retention channel may be configured to retain the locking protrusion in the locking orientation.

In yet another aspect, the locking protrusion retention channel may include an open end communicating with the locking protrusion release channel and configured to receive the locking protrusion, and a closed end communicating with the open end and retaining the locking protrusion in the locking orientation.

In yet another aspect, the locking assembly may be disposed proximate to the lower end of the mount tube for securing the adapter tube of the adapter assembly in the mount tube of the mount assembly, and the locking assembly may include a fixed plate fixed to the lower end of the mount tube, a movable plate, a connecting rod connecting the fixed plate and the movable plate, and a spring disposed between the fixed plate and the movable plate.

In yet another aspect, when the locking assembly secures the adapter tube in the mount tube in the locking orientation and the locking protrusion is retained in the locking protrusion retention channel, the spring may be in a compressed position and a distance between the fixed plate and the movable plate may be decreased.

In yet another aspect, the adapter tube may include: an open upper portion configured to receive the at least a portion of the umbrella pole; and a lower portion attached to the open upper portion and configured to be inserted into the mount aperture of the mount tube, and the locking channel may be disposed proximate to a lower end of the lower portion of the adapter tube, and the adapter assembly may further include one or more adjustable securement fasteners couplable to the open upper portion of the adapter tube and configured to secure the umbrella pole in the open upper portion.

In yet another aspect, the adapter tube may further include a shoulder disposed at an interface between the open upper portion and the lower portion of the adapter tube, and the shoulder may abut against the mount plate of the mount assembly when the lower portion of the adapter tube is inserted into the mount tube and the locking protrusion is disposed in the locking protrusion retention channel.

In yet another aspect, the mount assembly further may include a plurality of reinforcement bars attached along opposite sides of the mount tube.

In yet another aspect, the adapter tube may include a stopper tab disposed on the interior thereof above the locking channel and protruding inwards, and the stopper tab may be configured to engage a bottom end portion of the umbrella pole to prevent further insertion of the umbrella pole into the adapter tube.

In yet another aspect, the adapter tube may further include one or more securing tabs disposed on the interior thereof above the stopper tab and protruding inwards, and each of the one or more securing tabs may have a securing end configured to engage the umbrella pole and secure the umbrella pole in the adapter tube.

In yet another aspect, the mount plate may be attached to the mount tube to be substantially perpendicular to an axial direction of the mount tube.

In yet another aspect, the mount plate may be disposed at the upper end of the mount tube or at a height between the upper end of the mount tube and the locking protrusion.

In yet another aspect, the mount plate may include a locking position mark disposed at an upper surface thereof at a location corresponding to a position of the locking protrusion of the mount tube.

In yet another aspect, the mount plate may be attached to the mount tube to be substantially parallel to an axial direction of the mount tube.

In yet another aspect, the mount tube may include a plurality of fixing grooves disposed at the lower end thereof, the fixed plate may include a plurality of fixing protrusions corresponding to the plurality of fixing grooves of the mount tube, and the plurality of fixing protrusions may be fixedly coupled to the plurality of fixing grooves to prevent the fixed plate from entering the interior of the mount tube.

In still yet another aspect of the present invention, a mount assembly for an umbrella support system for securely retaining an umbrella canopy attached to an umbrella pole on a deck or an underlying substrate may include: a mount tube having a mount aperture disposed at an upper end thereof, a plurality of fixing grooves disposed at a lower end thereof, and an at least partially hollow interior; and a mount plate attached to the mount tube and configured to secure the umbrella support system to the deck or the underlying substrate; and a locking assembly disposed proximate to a lower end of the mount tube, and the locking assembly may include: a fixed plate including a plurality of fixing protrusions corresponding to the plurality of fixing grooves of the mount tube, and the fixed plate may be fixed to the lower end of the mount tube via the plurality of fixing protrusions and the plurality of fixing grooves; a movable plate; a connecting rod connecting the fixed plate and the movable plate; and a spring disposed between the fixed plate and the movable plate.

In still yet another aspect of the present invention, an adapter tube for an umbrella support system for securely retaining an umbrella canopy attached to an umbrella pole on a deck or an underlying substrate, the adapter tube having an at least partially hollow interior and configured to receive at least a portion of the umbrella pole and at least a portion of the adapter tube is configured to be inserted into a mount assembly of the umbrella support system having a locking protrusion, the adapter tube may include: a locking channel disposed at a lower end of the adapter tube and configured to allow the locking protrusion of the mount assembly to move therethrough in and out of a locking orientation; a stopper tab disposed on the at least partially hollow interior of the adapter tube above the locking channel and protruding inwards, wherein the stopper tab is configured to engage a bottom end portion of the umbrella pole to prevent further insertion of the umbrella pole into the adapter tube; and one or more securing tabs disposed on the at least partially hollow interior of the adapter tube above the stopper tab and protruding inwards, wherein the one or more securing tabs have a sharp securing end configured to engage the umbrella pole and secure the umbrella pole in the adapter tube.

In yet another aspect, the locking channel may include a locking protrusion release channel and a locking protrusion retention channel in communication with the locking protrusion release channel, and the locking protrusion retention channel may be disposed to be substantially perpendicular to the locking protrusion release channel, the locking protrusion release channel may be substantially parallel to an axial direction of the adapter tube, and the locking protrusion retention channel may be configured to retain the locking protrusion in the locking orientation.

In yet another aspect, the locking protrusion retention channel includes an open end communicating with the locking protrusion release channel and configured to receive the locking protrusion, and a closed end communicating with the open end and retaining the locking protrusion in the locking orientation.

These and other objects, features, and advantages of the present invention will become more readily apparent from the attached drawings and the detailed description of the embodiments, which follow.

BRIEF DESCRIPTION OF THE DRAWINGS

The embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "top", "bottom", "left", "right", "front", "rear", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. Itis also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The present invention is directed to a deck umbrella support system, generally as shown as 100 throughout the figures. More in particular, in at least one embodiment, the present deck umbrella support system 100 is provided to securely retain an umbrella canopy that is attached to an umbrella pole on a deck, wherein the deck has a receiving aperture formed through a surface thereof, and at least a portion of the umbrella pole is disposed through the receiving aperture and is below the surface of the deck while the umbrella is supported by the present system 100.

Figure 1:
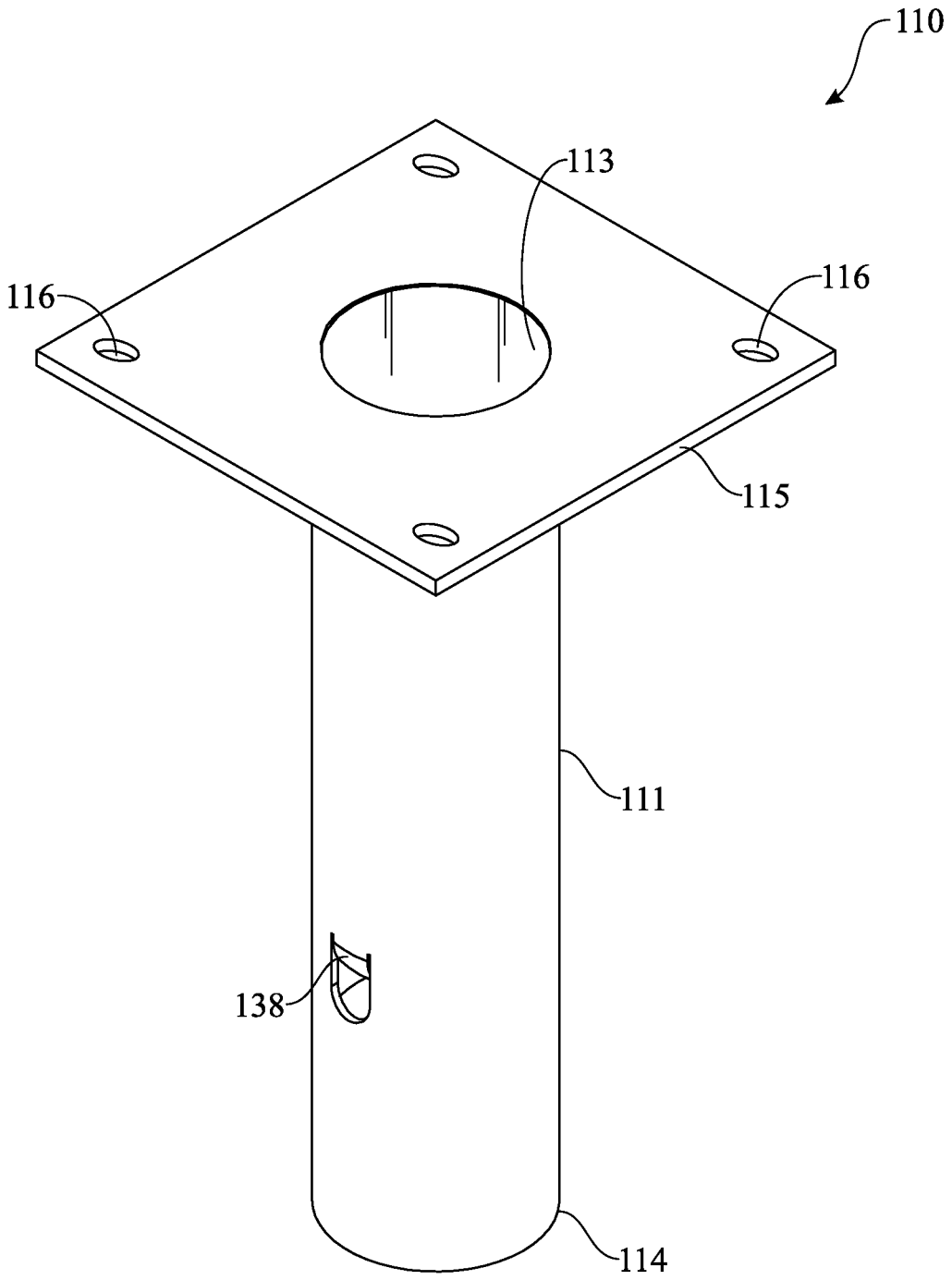
FIG. 1 presents a top perspective view of a mount assembly of a deck umbrella support system, in accordance with an embodiment the present invention.
Figure 2:
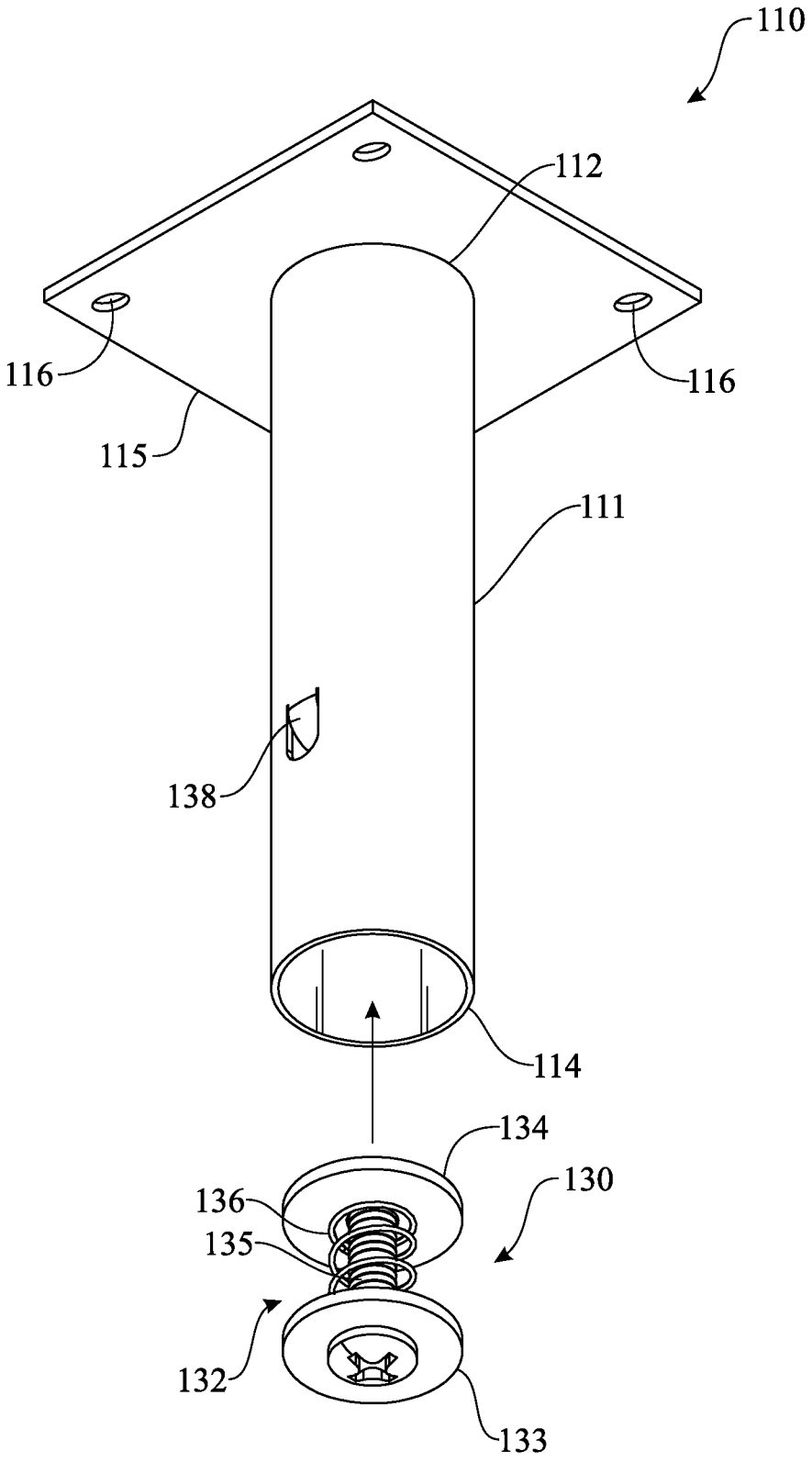
FIG. 2 presents a partially exploded bottom perspective view of the mount assembly of FIG. 1 of the deck umbrella support system and a locking unit, in accordance with the present invention.

Referring initially to FIGS. 1 and 2, shown therein are top and bottom perspective views of one illustrative embodiment of a mount assembly 110 in accordance with the present invention. A mount assembly 110 in one embodiment of the present invention includes a mount tube 111. As further shown in FIGS. 1 and 2, the mount tube 111 has an upper end 112 and a lower end 114. An upper end 112 of one embodiment of a mount tube 111 includes a mount aperture 113 formed therethrough, and in one further embodiment, a mount tube 111 includes an at least partially hollow interior so as to receive a portion of an adapter assembly 120 therein, as discussed in greater detail below.

As shown throughout the figures, a mount tube 111 of a mount assembly 110 comprises a generally elongated cylindrical configuration, however, is to be appreciated that a mount tube 111 may comprise other geometric configurations including square, triangular, hexagonal, etc., just to name a few, which are within the scope and intent of the present invention. Further, a mount tube 111 in accordance with the present invention may be constructed of any of a variety of rigid materials which provide sufficient structural integrity to perform the required functions, including, but in no manner limited to, metals such as steel, stainless steel, iron, copper, aluminum, etc., metal alloys, as well as any of a variety of plastics, thermoplastics, fiberglass, graphite, or composite materials, once again, just to name a few.

A mount tube 111 of a mount assembly 110 has a mount plate 115 attached to it, in accordance with at least one embodiment of the present invention. With reference once again to FIGS. 1 and 2, a mount plate 115 is disposed around a mount aperture 113 through an upper end 112 of the mount tube 111, and the mount plate 115 may be substantially perpendicular to an axial direction of the mount tube 111, as shown in FIGS. 1 and 2. In at least one embodiment, a mount plate 115 is secured to the mount tube 111 around the mount aperture 113 through the upper end 112. A mount plate 115 includes at least one fastener aperture 116 disposed through a portion thereof to allow at least one fastener 117 to be used to secure the mount plate 115, and the mount tube 111 attached thereto, to at least a portion of a deck or an underlying substrate. As may be seen from the illustrative embodiments of FIGS. 1 and 2, a mount plate 115 includes a plurality of fastener apertures 116, and more in particular, a plurality of fastener apertures 116 which are each dimensioned and configured to receive a fastener 117 therethrough so as to secure the mount plate 115, and once again, the mount tube 111 attached thereto, to a portion of a deck or an underlying substrate.

Similar to a mount tube 111, a mount plate 115 in accordance with the present invention may also be constructed of any of a variety of rigid materials which provide sufficient structural integrity to perform the required functions, including, once again, metals such as steel, stainless steel, iron, copper, aluminum, etc., metal alloys, as well as any of a variety of plastics, thermoplastics, fiberglass, graphite, or composite materials, among others. Itis understood to be within the scope and intent of the present invention for a mount tube 111 and a mount plate 115 to be constructed independently and thereafter secured to one another such as by welding, soldering, adhesives, mechanical fasteners, etc. It is further understood that in at least one embodiment a mount tube 111 and a mount plate 115 of a mount assembly 110 in accordance with the present invention comprise a unitary construction with one another.

Figure 3:
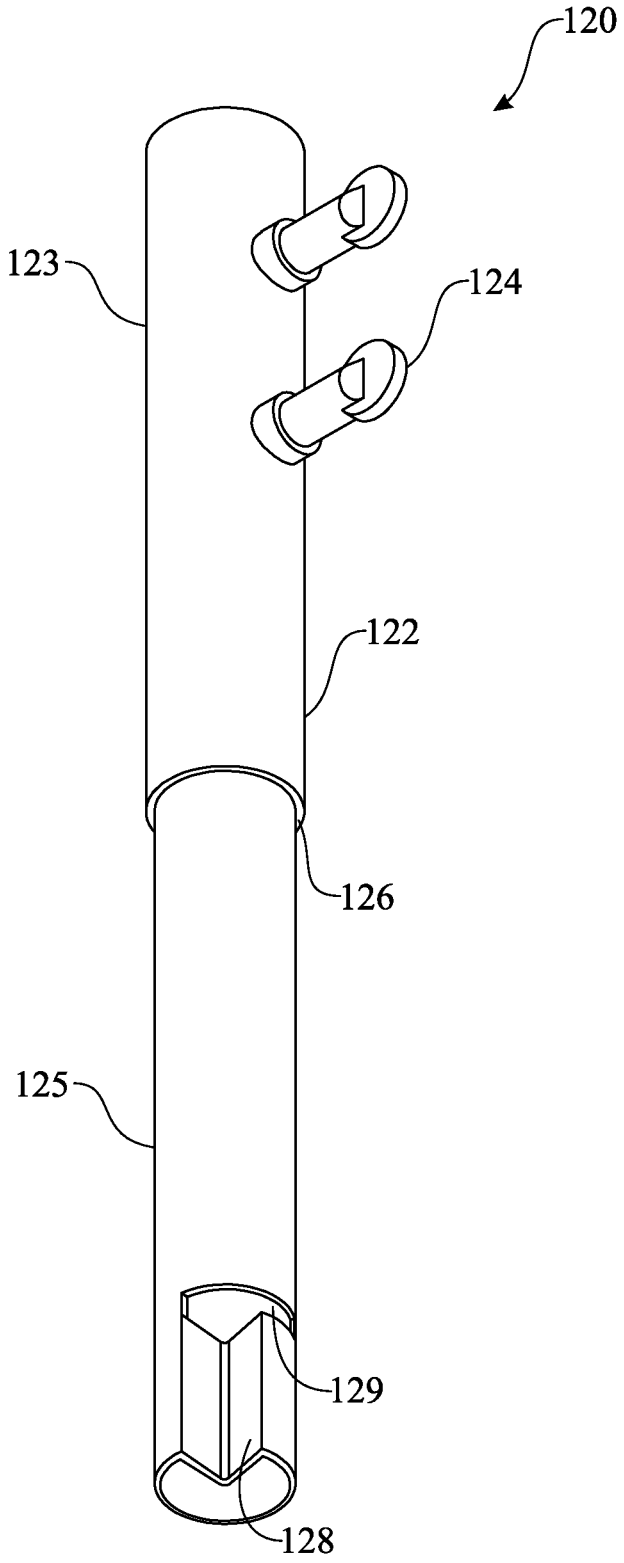
FIG. 3 presents a bottom perspective view of one illustrative embodiment of an adapter assembly of a deck umbrella support system, in accordance with an embodiment of the present invention.

A deck umbrella support system 100 in accordance with at least one embodiment of the present invention further comprises an adapter assembly 120. With reference to FIG. 3, an adapter assembly 120 includes an adapter tube 122. In one embodiment, an adapter tube 122 includes an open upper portion 123 and a lower portion 125, and in at least one further embodiment, an adapter tube 122 includes an open upper portion 123 attached to a lower portion 125. As shown in the illustrative embodiment of FIG. 3, an adapter tube 122 includes an open upper portion 123 attached to a lower portion 125, and further having a shoulder 126 formed at an interface between the open upper portion 123 and the lower portion 125, the significance of which will become apparent hereinafter.

Similar to mount tube 111, as shown throughout the figures, an adapter tube 122 of an adapter assembly 120 comprises an elongated cylindrical configuration, and the adapter assembly 120 and the mount assembly 110 are coaxial with one another. However, once again, it is to be appreciated that it is within the scope and intent of the present invention for either or both of an open upper portion 123 and a lower portion 125 of an adapter tube 122 to comprise other geometric configurations including square, triangular, hexagonal, etc., just to name a few. Furthermore, and also similar to mount tube 111, an adapter tube 122 in accordance with the present invention may be constructed of any of a variety of rigid materials which provide sufficient structural integrity to perform the required function, including but not limited to metals such as steel, stainless steel, iron, copper, aluminum, etc., metal alloys, as well as any of a variety of plastics, thermoplastics, fiberglass, graphite, or composite materials, again, just to name a few.

An open upper portion 123 of an adapter tube 122 is dimensioned and configured to receive at least a portion of an umbrella pole of an umbrella therein. As such, in at least one embodiment, an adapter tube 122 includes at least one adjustable securement fastener 124 operably interconnected thereto. More in particular, in one embodiment, an adjustable securement fastener 124 is threadably interconnected through a wall of an open upper portion 123 of an adapter tube 122 and operates in the manner of a set screw, whereby turning the adjustable securement fastener 124 inwardly causes a portion of the adjustment securement fastener 124 to extend into the open upper portion 123 of the adapter tube 122, and into contact with the portion of the umbrella pole disposed therein. As will be appreciated, in this manner, the adjustable securement fastener 124 serves to adjustably secure the portion of the umbrella pole in the adapter tube 122. In at least one further embodiment, an adapter tube 122 of an adapter assembly 120 comprises a plurality of adjustable securement fasteners 124 operably interconnected thereto, such as is shown by way of example in FIG. 3, wherein each of the plurality of adjustable securement fasteners 124 serves to adjustably secure the portion of the umbrella pole in the adapter tube 122.

In one further embodiment, an adapter tube 122 of an adapter assembly 120 further comprises a locking channel. The locking channel comprises a locking protrusion release channel 128 and a locking protrusion retention channel 129 disposed to be in communication with the locking protrusion release channel 128. As the names imply, a locking protrusion release channel 128 is configured to allow a locking protrusion 138, described in more detail hereinafter, to move therethrough into and out of a locking orientation, whereas the locking protrusion retention channel 129 is configured to retain a locking protrusion 138 in a locking orientation therein until such time as it is released therefrom by a user.

Looking again with reference to FIG. 3, in at least one embodiment, a locking protrusion retention channel 129 is disposed in a substantially perpendicular relation to a locking protrusion release channel 128, and further, is disposed substantially vertical orientation, or parallel, relative to an axial direction of an adapter tube 122 of the present invention, the significance of which will become apparent hereinafter.

The dimensions of the mount assembly and the adapter assembly may be modified to accommodate various factors depending on, for example, the size of the umbrella pole being secured in the adapter assembly, the dimensions of the deck in which the mount tube is being secured, the size of the umbrella canopy attached to the umbrella pole, the type and depth of underlying substrate, etc.

A deck umbrella support system 100 in at least one embodiment further comprises a locking assembly 130. A locking assembly 130 in accordance with the present invention includes a locking unit 132. More in particular, in at least one embodiment, a locking assembly 130 includes a locking unit 132 operable to secure at least a portion of an adapter tube 122 of an adapter assembly 120 in a mount tube 111 of a mount assembly 110. In at least one further embodiment, a locking assembly 130 includes a locking unit 132 which is operably positioned proximate a lower end 114 of a mount tube 111.

With reference once again to FIG. 2, a locking unit 132 of a locking assembly 130 includes a fixed member 133 and a movable member 134, both of which can be a circular plate or the like. In at least one embodiment, a fixed member 133 and a movable member 134 of a locking unit 132 are operably interconnected to one another via a connecting member 135. As shown throughout the figures, a connecting member 135 may be a rod or the like and include a threaded bolt like portion onto which each of a fixed member 133 and a movable member 134 are positioned over and are retained in place thereon via a nut. As will be appreciated, a connecting member 135 may comprise other forms of mechanical fasteners within the scope and intent of the present invention including, but in no manner limited to, a rivet, a bolt and cotter pin, a binding post and screw, etc., just to name a few. In at least one further embodiment, a locking unit 132 of a locking assembly 130 further comprises a biasing element 136. With reference once again to the illustrative embodiment of FIG. 2, a biasing element 136 is operatively positioned between a fixed member 133 and a movable member 134 of a locking unit 132.

A mount tube 111 in accordance with the present invention further comprises a locking protrusion 138. As may be seen in FIGS. 1 and 2, in at least one embodiment, a locking protrusion 138 is disposed on the hollow interior of a mount tube 111 of the mount assembly 110 and extends inwards, proximate a lower end 114 thereof. As further shown in the illustrative embodiments of FIGS. 1 and 2, in at least one further embodiment, a locking protrusion 138 may be a tab formed via a punch out through and into an interior portion of a mount tube 111, once again, proximate a lower end 114 thereof. As will be appreciated, a locking protrusion 138 in accordance with the present invention may comprise any of a number of protrusion configurations which extend at least partially into or out of a portion of a mount tube 111.

Figure 4:
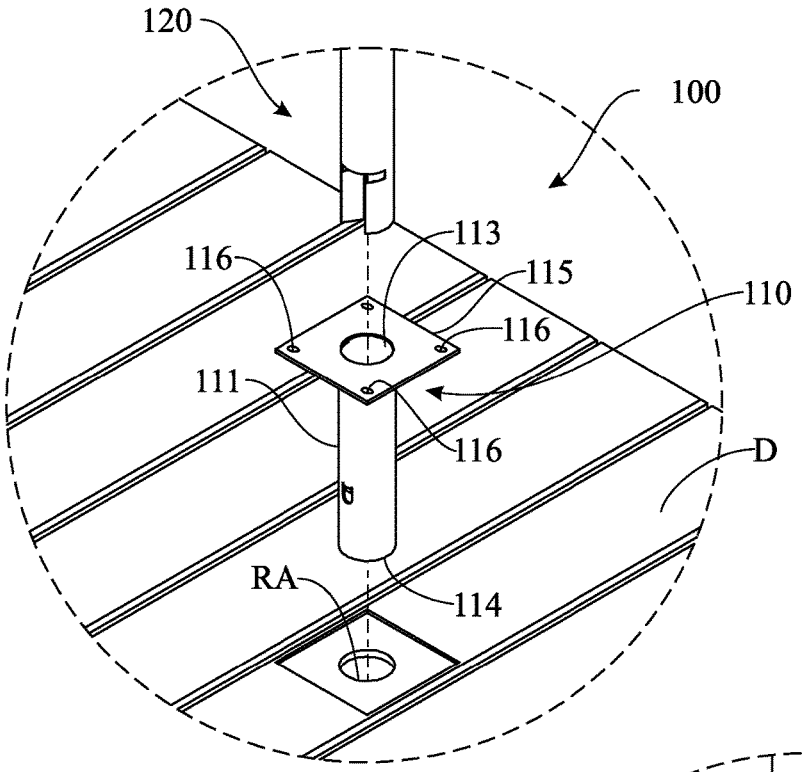
FIG. 4 presents a partially exploded perspective view of a mount assembly and an adapter assembly of a deck umbrella support system, in accordance with the embodiment of the present invention.
Figure 5:
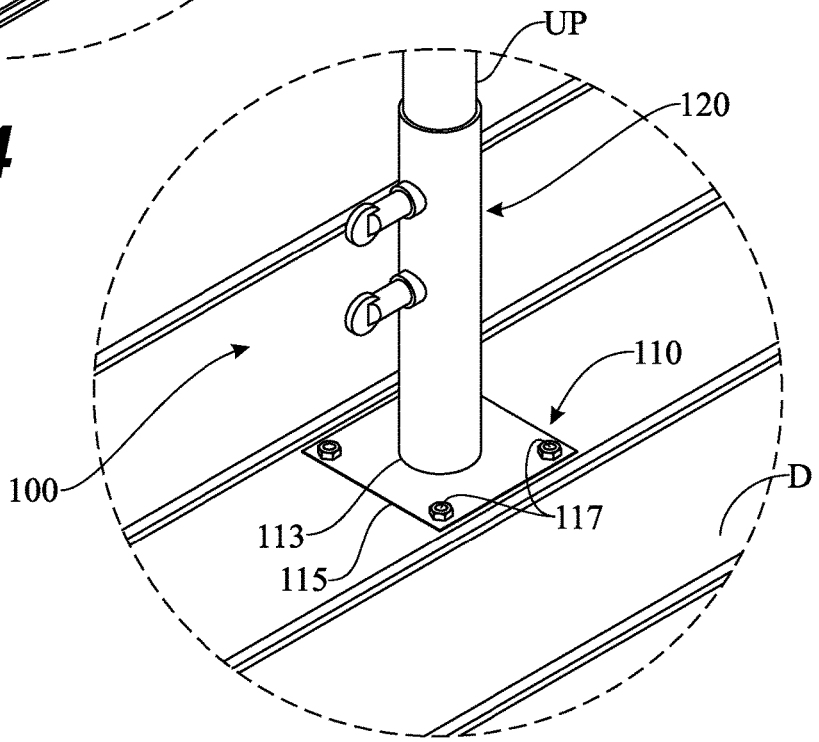
FIG. 5 presents a perspective view of the adapter assembly of FIG. 4 disposed in an operative orientation with the mount assembly of FIG. 4 of the deck umbrella support system installed through a portion of a deck.
Figure 6:
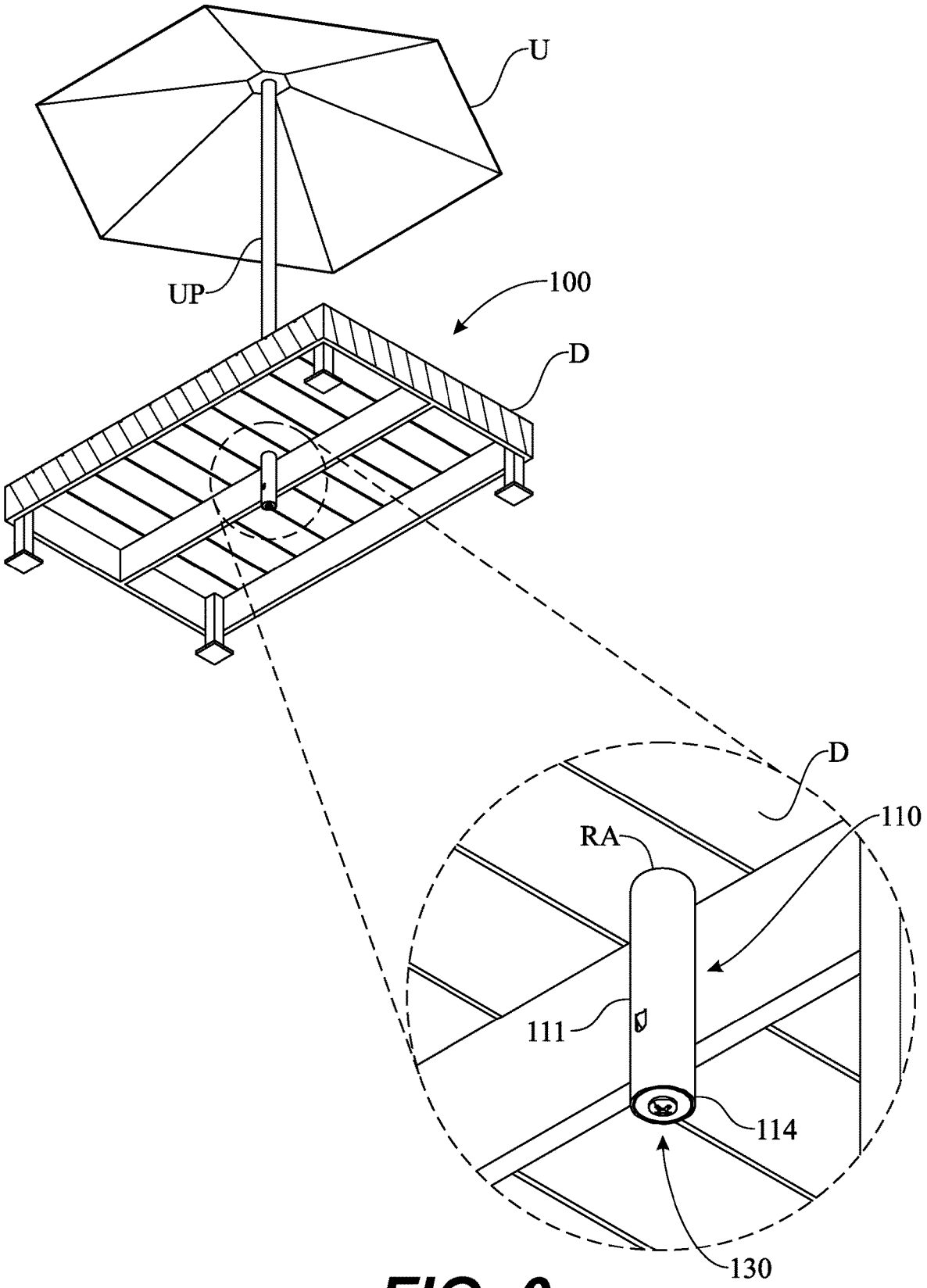
FIG. 6 presents a bottom perspective view of the illustrative embodiment of the deck umbrella support system of FIGS. 4 and 5 installed on a deck and having an umbrella supported therein.

Turning next to FIGS. 4 through 6, presented therein are perspective views of one illustrative embodiment of a deck umbrella support system 100 installed through a portion of a deck (D) in accordance with the present invention. To begin, and with reference to FIG. 4, a mount assembly 110 includes a mount tube 111 having a mount plate 115 attached thereto and disposed around a mount aperture 113 thereof. As before, the mount plate 115 comprises a plurality of fastener apertures 116 formed therethrough. The deck (D) includes a receiving aperture (RA) formed through portion thereof which is dimensioned to receive a lower end 114 of a mount tube 111 therethrough. With reference next to FIG. 5, a plurality of fasteners 117 are received through corresponding ones of the plurality of fastener apertures 116, as shown in FIG. 4, so as to secure the mount plate 115 to the deck (D) while the mount tube 111 is disposed at least partially through the receiving aperture (RA) through a portion of the deck (D). As further shown in FIG. 5, a portion of an adapter assembly 120 is received through the mount aperture 113, once again, as shown in FIG. 4, of mount tube 111, and the adapter assembly 120 includes at least a portion of an umbrella pole (UP) of an umbrella (not shown) disposed therein.

FIG. 6 presents a bottom perspective view of the illustrative embodiment of a deck umbrella support system 100, as shown in FIGS. 4 and 5, installed on a deck (D) and having an umbrella canopy (U) mounted to an umbrella pole (UP) supported therein, in accordance with the present invention. With reference in particular to the enlarged inset in FIG. 6, a mount tube 111 of a mount assembly 110 is positioned at least partially through a receiving aperture (RA) through a portion of the deck (D), for receiving a portion of an adapter assembly 120 having a portion of an umbrella pole releasably secured therein. As further shown in FIG. 6, a locking assembly 130 is operatively disposed in a lower end 114 of a mount tube 111 to facilitate disposition of a portion of an adapter assembly 120 into an operative secured engagement with a mount assembly 110 via the locking assembly 130 of the present deck umbrella support system 100, as described hereinafter.

Figure 7A:
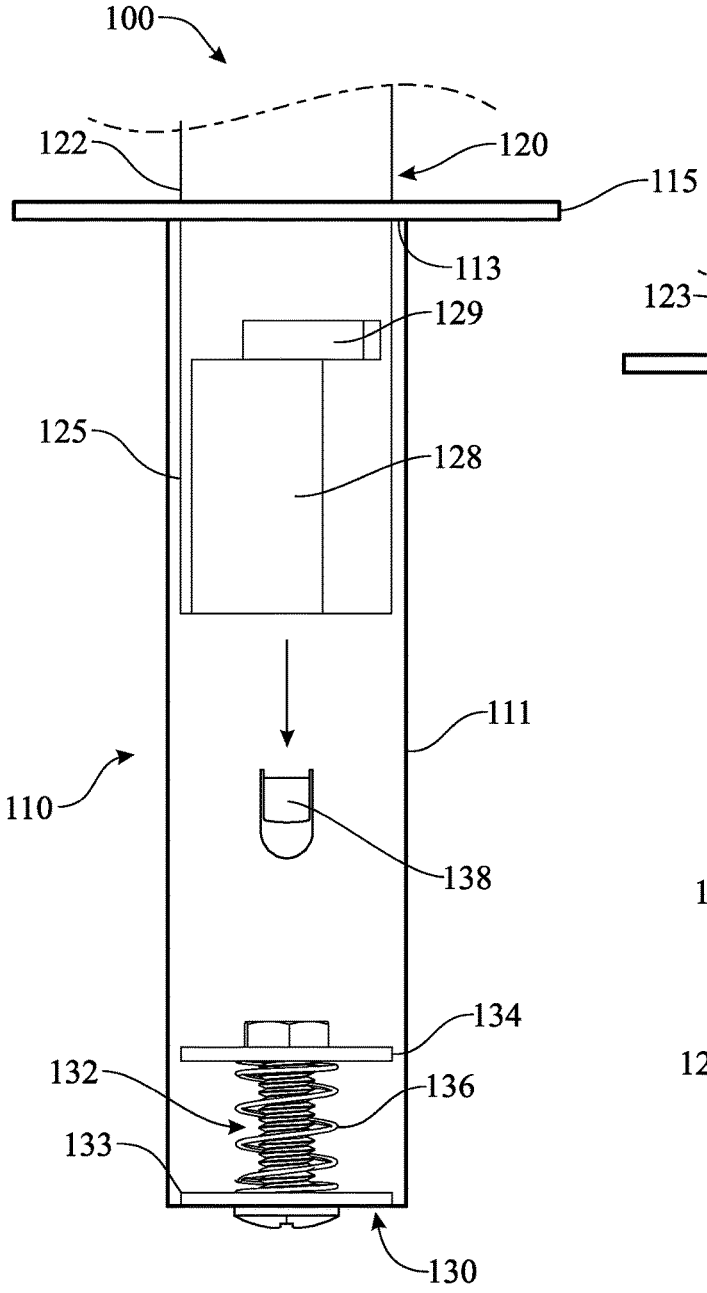
FIGS. 7A through 7C present partial cutaway views of one illustrative embodiment of an adapter assembly being disposed into an operative secured engagement with a mount assembly via a locking assembly of a deck umbrella support system, in accordance with the embodiment of the present invention.
Figure 7B:
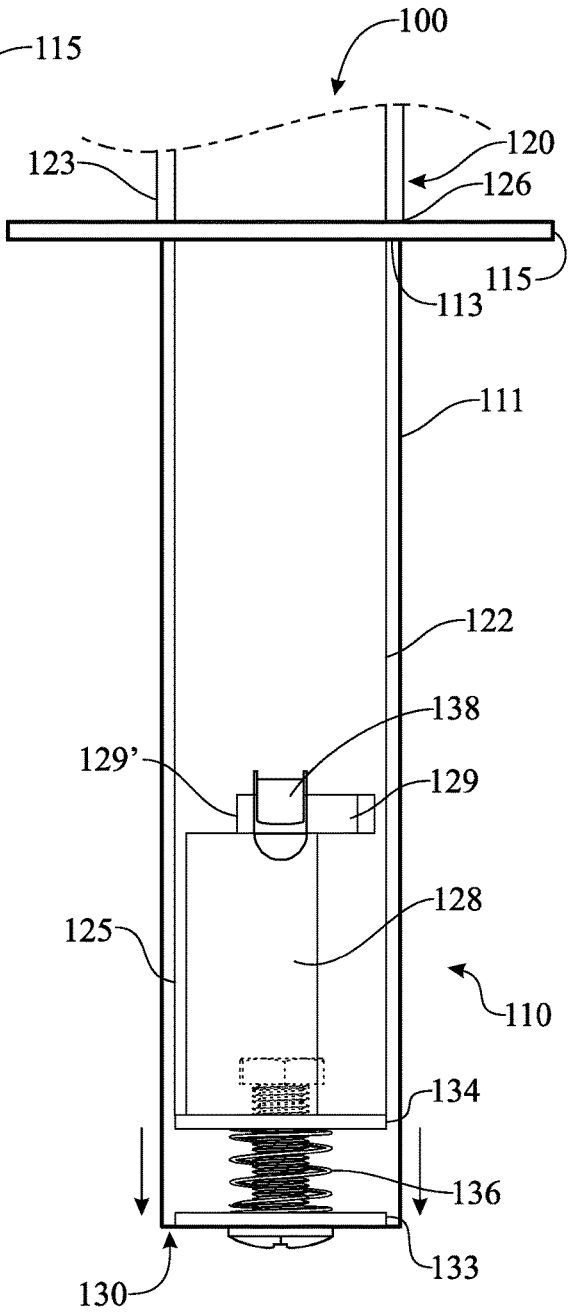
Figure 7C:
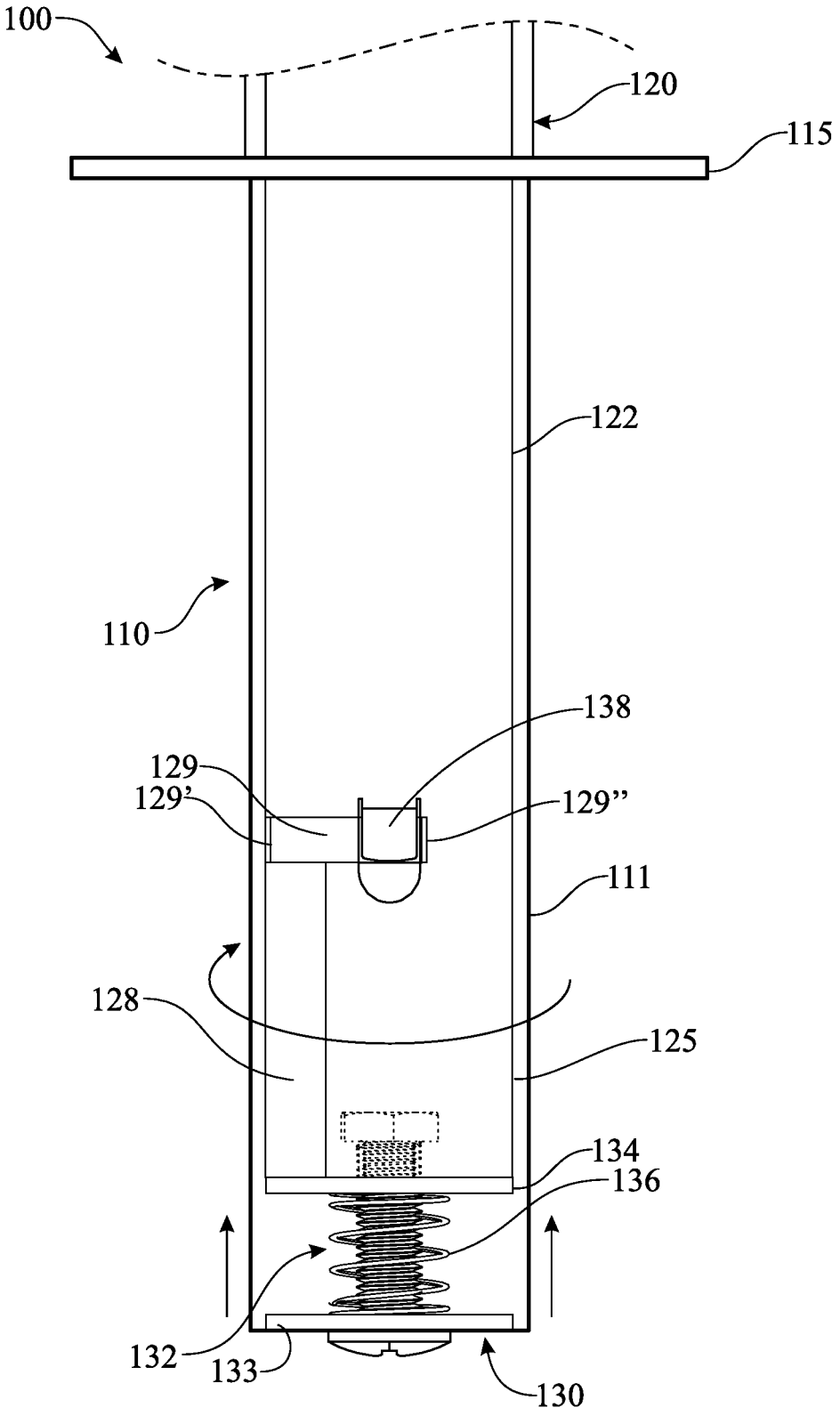

Looking next to FIGS. 7A through 7C, presented therein are partial cutaway views of one illustrative embodiment of an adapter assembly 120 being disposed into an operative secured engagement with a mount assembly 110 via a locking assembly 130 of a deck umbrella support system 100, in accordance with at least one embodiment of the present invention.

Beginning with FIG. 7A, a lower portion 125 of an adapter tube 122 is disposed through a mount aperture 113 and at least partially into a hollow interior of a mount tube 111. As shown by the downward directional arrow in FIG. 7A, the lower portion 125 of the adapter tube 122 is positioned such that the locking protrusion release channel 128 is disposed is a substantially aligned orientation with a locking protrusion 138. As further shown in 7A, a biasing element 136, which may be, for example, a linear spring, of a locking assembly 130 is disposed in a fully uncompressed disposition such that a movable member 134 is disposed at a maximum distance from a fixed member 133 about a connecting member 135.

Looking next to FIG. 7B, as the lower portion 125 of the adapter tube 122 is inserted further through the mount aperture 113 and into the hollow interior of the mount tube 111, the lower portion 125 of the adapter tube 122 operatively engages the movable member 134 of the locking assembly 130 and moves the movable member 134 towards the fixed member 133 upon application of a downward force to the adapter tube 122, and thus, to the lower portion 125 of the adapter tube 122, which is greater than an upward force exerted by the biasing element 136, thereby disposing the biasing element 136 into a compressed configuration, such as is demonstrated diagrammatically by the downward directional arrows in FIG. 7B. As further shown in FIG. 7B, the lower portion 125 of the adapter tube 122 is inserted into the mount tube 111 until the shoulder 126 disposed between the open upper portion 123 and the lower portion 125 of the adapter tube 122 abuts against the mount plate 115 of the mount assembly 110, at which point, the locking protrusion 138 has passed through the locking protrusion release channel 128 and into an open end 129' of a locking protrusion retention channel 129.

Finally, and with reference to FIG. 7C, the adapter tube 122 is rotated as represented diagrammatically by the arcuate directional arrow, in this instance, in a clockwise direction, such that locking protrusion 138 is disposed through the locking protrusion retention channel 129 from an open end 129' to a closed-end 129" thereof, as shown best in FIG. 7C. As further shown in FIG. 7C, an upward force exerted by the biasing element 136, as demonstrated diagrammatically by the upwardly directed arrows in FIG. 7C, disposes the movable member 134 of the locking assembly 130 into contact with the lower portion 125 of the adapter tube 122, thereby maintaining the locking protrusion 138 disposed in the closed end 129" of the locking protrusion retention channel 129 while the lower portion 125 of the adapter tube 122 is disposed in an operative secured engagement with the mount tube 111, as shown best in FIG. 7C. The adapter tube 122 may be released from the operative secured engagement with the mount tube 111 by a user of the adapter tube 122 by following the aforementioned sequence of actions in reverse, i.e., rotating the adapter tube in a counterclockwise direction, thereby allowing the locking protrusion 138 to dispose from the closed end 129" to the open end 129' of the locking protrusion retention channel 129 and to move through the locking protrusion release channel 128 with the aid of the upward force of the biasing element 136.

Figure 8:
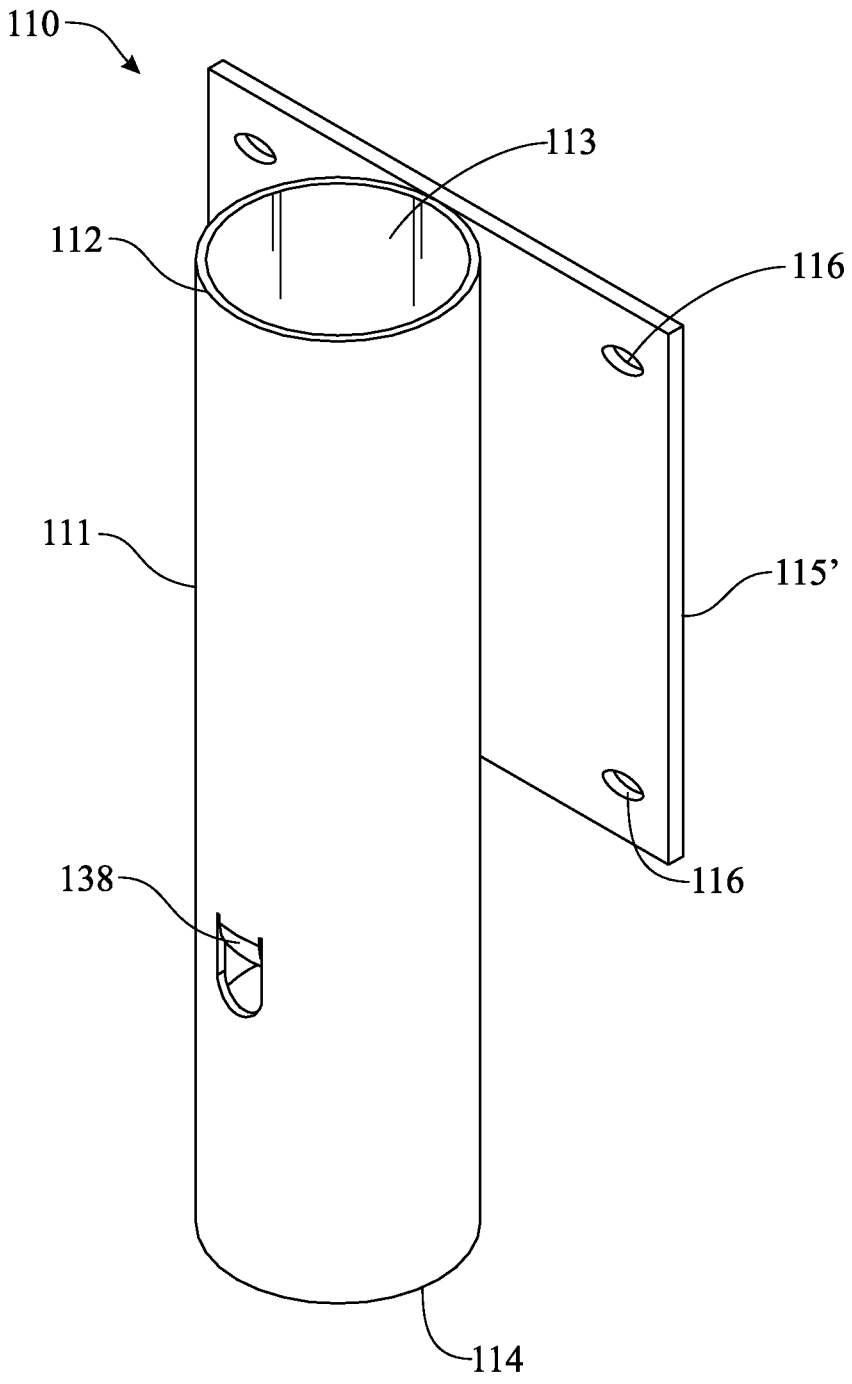
FIG. 8 presents a top perspective view of a mount assembly of a deck umbrella support system, in accordance with another embodiment of the present invention.
Figure 9:
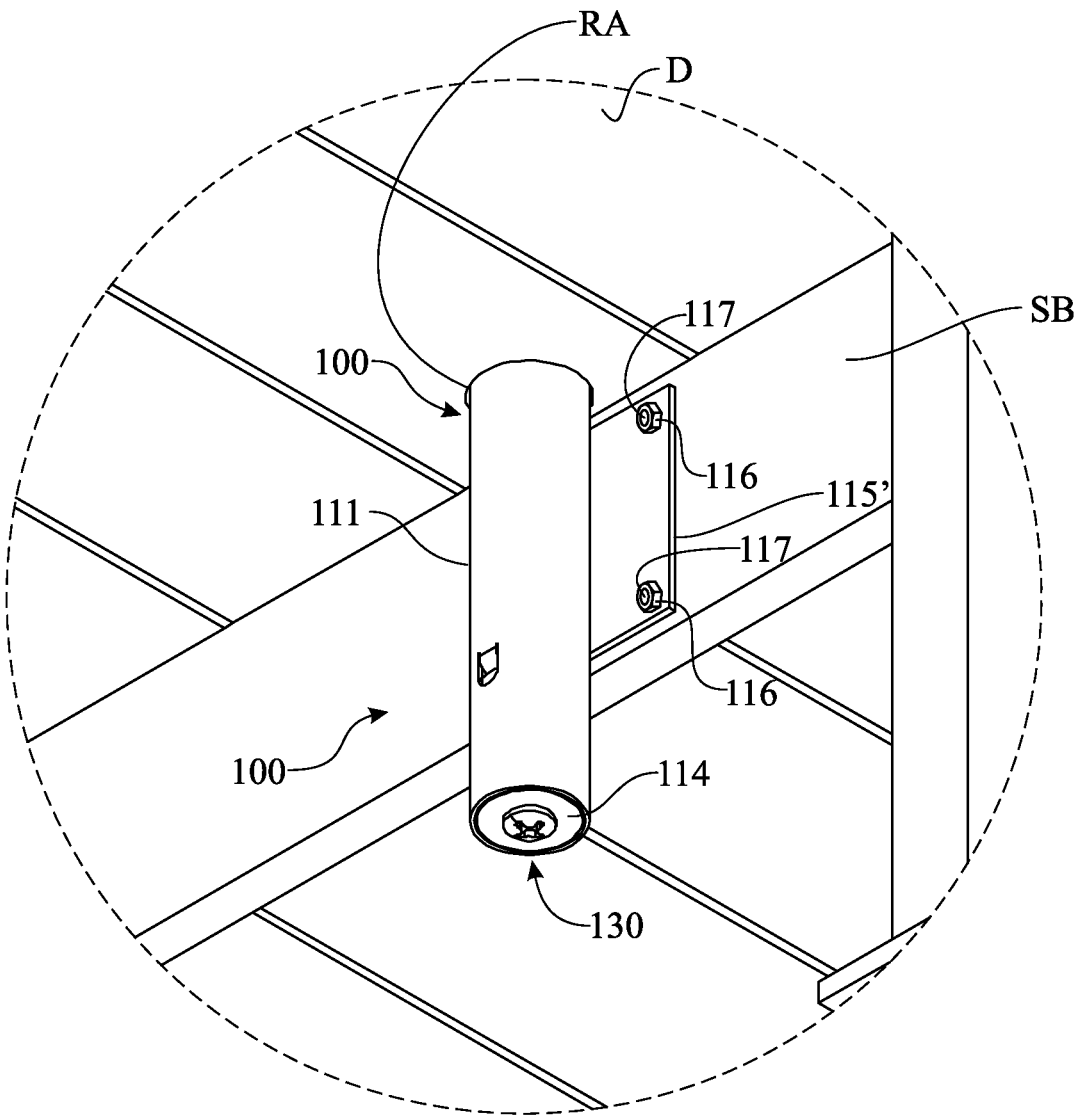
FIG. 9 presents a bottom perspective view of the mount assembly of FIG. 8 of the deck umbrella support system installed under a deck.

Alternative embodiments are contemplated in addition the embodiments(s) shown and/or described herein. For example, FIGS. 8 and 9 are illustrative of a second illustrative embodiment of a mount assembly 110 of a deck umbrella support system 100, in accordance with the present invention. More in particular, and as may be seen from FIG. 8, a mount assembly 110 again includes a mount tube 111 having an upper end 112 with a mount aperture 113 disposed therethrough and an oppositely disposed lower end 114. However, unlike the illustrative embodiments of FIGS. 1 through 7C, a mounting plate 115' is secured along one side of a mount tube 111, i.e., the mounting plate 115' may be attached to the mount tube 111 to be substantially parallel to an axial direction of the mount tube 111. Looking next to FIG. 9, the mounting plate 115' is configured to be secured to a support beam (SB) disposed on the underside of the deck (D), once again, via a plurality of fasteners 117 disposed through corresponding ones of fastener apertures 116. As further shown in FIG. 9, a portion of the mount tube 111 is disposed upwardly and at least partially into a receiving aperture (RA) disposed through the deck (D), to facilitate receipt of a portion of an adapter assembly 120, having a portion of an umbrella pole releasably secured thereto, in an operative secured engagement therein. As before, a locking assembly 130 is disposed proximate a lower end 114 of the mount tube 111.

Figure 10:
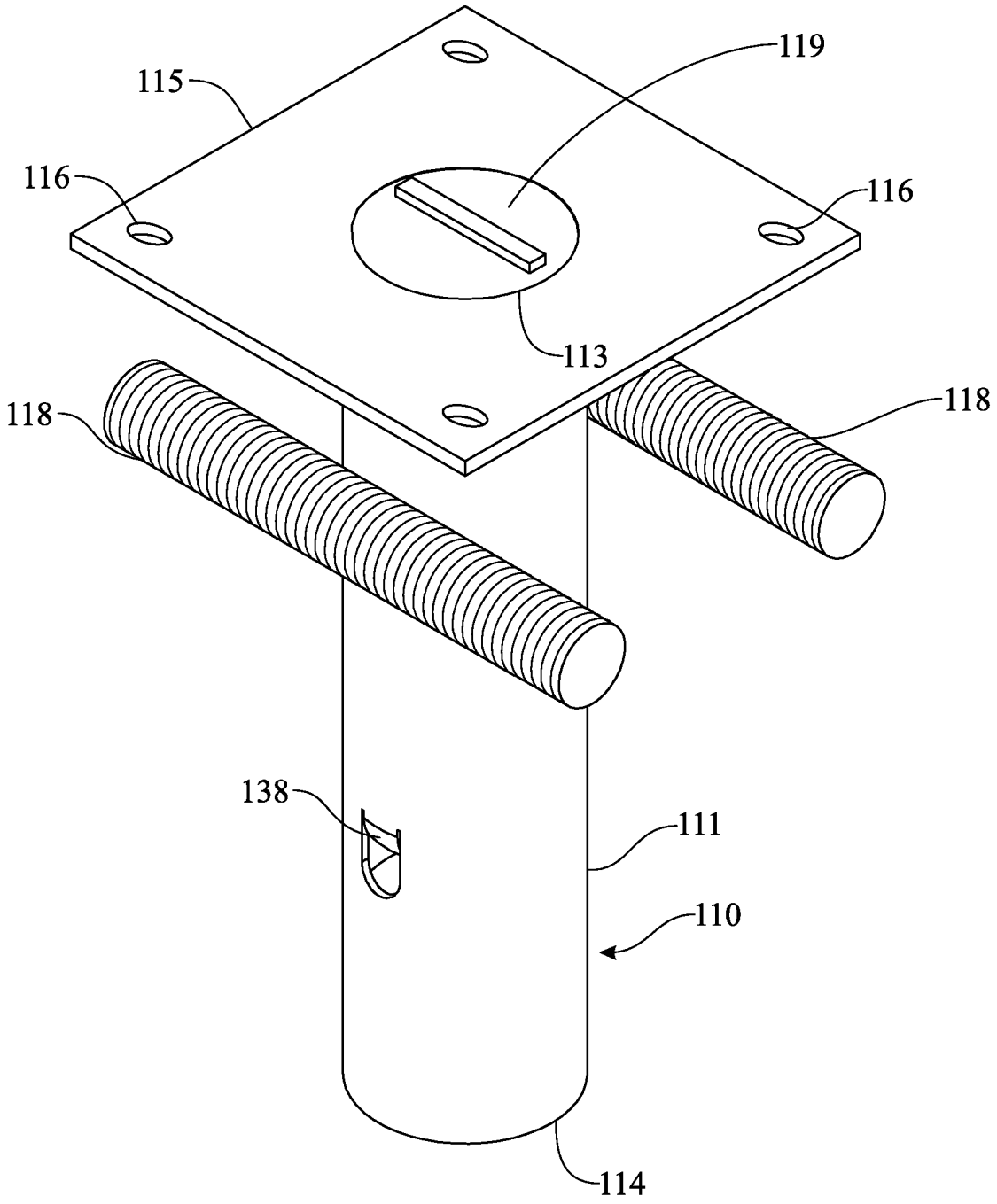
FIG. 10 presents a top perspective view of a mount assembly of a deck umbrella support system, in accordance with yet another embodiment of the present invention.
Figure 11:
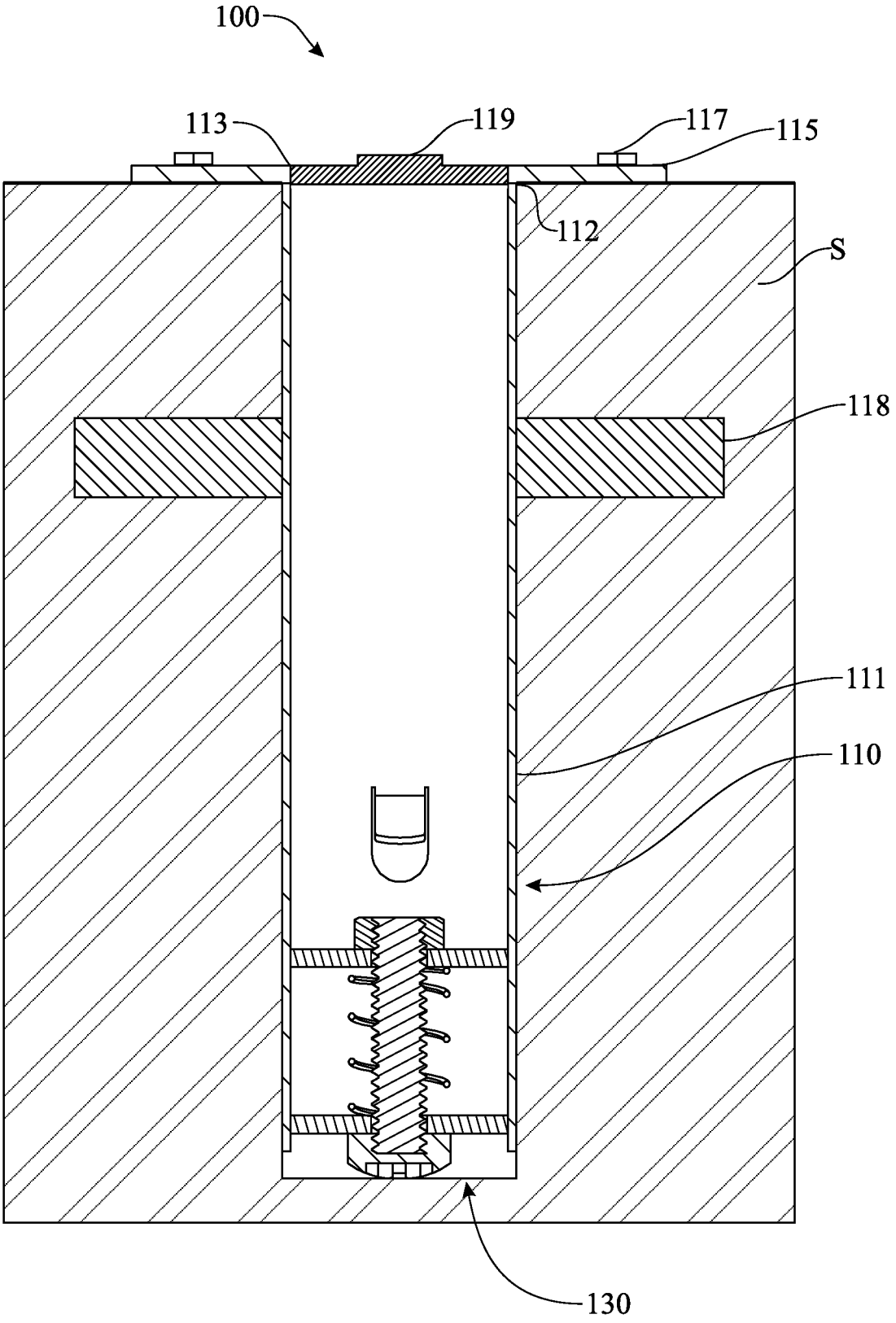
FIG. 11 presents a cross-sectional elevation of the mount assembly of FIG. 10 of the deck umbrella support system installed in an underlying substrate.

FIGS. 10 and 11 are illustrative of a third illustrative embodiment of a mount assembly 110 of a deck umbrella support system 100, in accordance with the present invention. Once again, and as before, a mount assembly 110 includes a mount tube 111 having an upper end 112, an oppositely disposed lower end 114, and a mount plate 115 disposed around a mount aperture 113 through and into the upper end 112 of the mount tube 111. In at least one embodiment, a cap 119 is provided to cover a mount aperture 113 through and into the upper end 112 of the mount tube 111, while the present deck umbrella support system 100 is not in use. In the present embodiment of a deck umbrella support system 100, at least one reinforcement member 118 is provided to facilitate secure installation of the mount tube 111 into an underlying substrate over which a deck is constructed. As will be appreciated, the underlying substrate may include soil, sand, gravel, concrete, etc.

As best seen in FIG. 10, in at least one embodiment, the present deck umbrella support system 100 comprises a plurality of reinforcement members 118 attached along opposite sides of a mount tube 111 of the mount assembly 110. A reinforcement member 118 in accordance with the present invention may comprise an elongated configuration extending outwardly from the sides of a mount tube 111 so as to counter or offset any upward or lateral forces which may be exerted upon the mount tube 111 by an umbrella attached to an umbrella pole and releasably secured in an adapter assembly 120 (not shown in FIGS. 10 and 11), which is subsequently disposed into an operative secured engagement with the mount tube 111. As will be appreciated, the reinforcement member 118 may comprise a reinforcing bar, more commonly known as rebar, such as are typically constructed of iron or steel, however, a reinforcement member 118 in accordance with the present invention may well comprise other suitable materials of construction such as, once again, metals, metal alloys, plastics, thermoplastics, fiberglass, composite materials, etc.

With reference next to FIG. 11, a cross-sectional elevation of the mount assembly 110 of FIG. 10 of a deck umbrella support system 100 installed in an underlying substrate (S) in accordance with the present invention is presented. As may be seen from FIG. 11, a mount plate 115 is mounted onto the surface of the underlying substrate (S) and fasteners 117 are provided to further secure the mount plate 115 onto the underlying substrate (S) and, more importantly, to secure the mount tube 111 attached thereto in position in the underlying substrate (S). As before, the reinforcement member 118 attached to portions of the mount tube 111 serve so as to counter or offset any upward or lateral forces which may be exerted upon the mount tube 111 by an umbrella attached to an umbrella pole and releasably secured in an adapter assembly 120 (not shown in FIGS. 10 and 11), which is subsequently disposed into an operative secured engagement with the mount tube 111, thereby securing the umbrella in place to provide shade and/or cover from the elements over a portion of the deck.

Referring now to FIGS. 12-17, yet other embodiments of the umbrella support system of the present invention are illustrated. In the embodiments shown in FIGS. 12-17, the mount assembly 110 and locking assembly 130 are substantially similar to the embodiments shown in FIGS. 1-2 above, and description therefor will not be reiterated herein unless to describe a modified feature.

Figure 12:
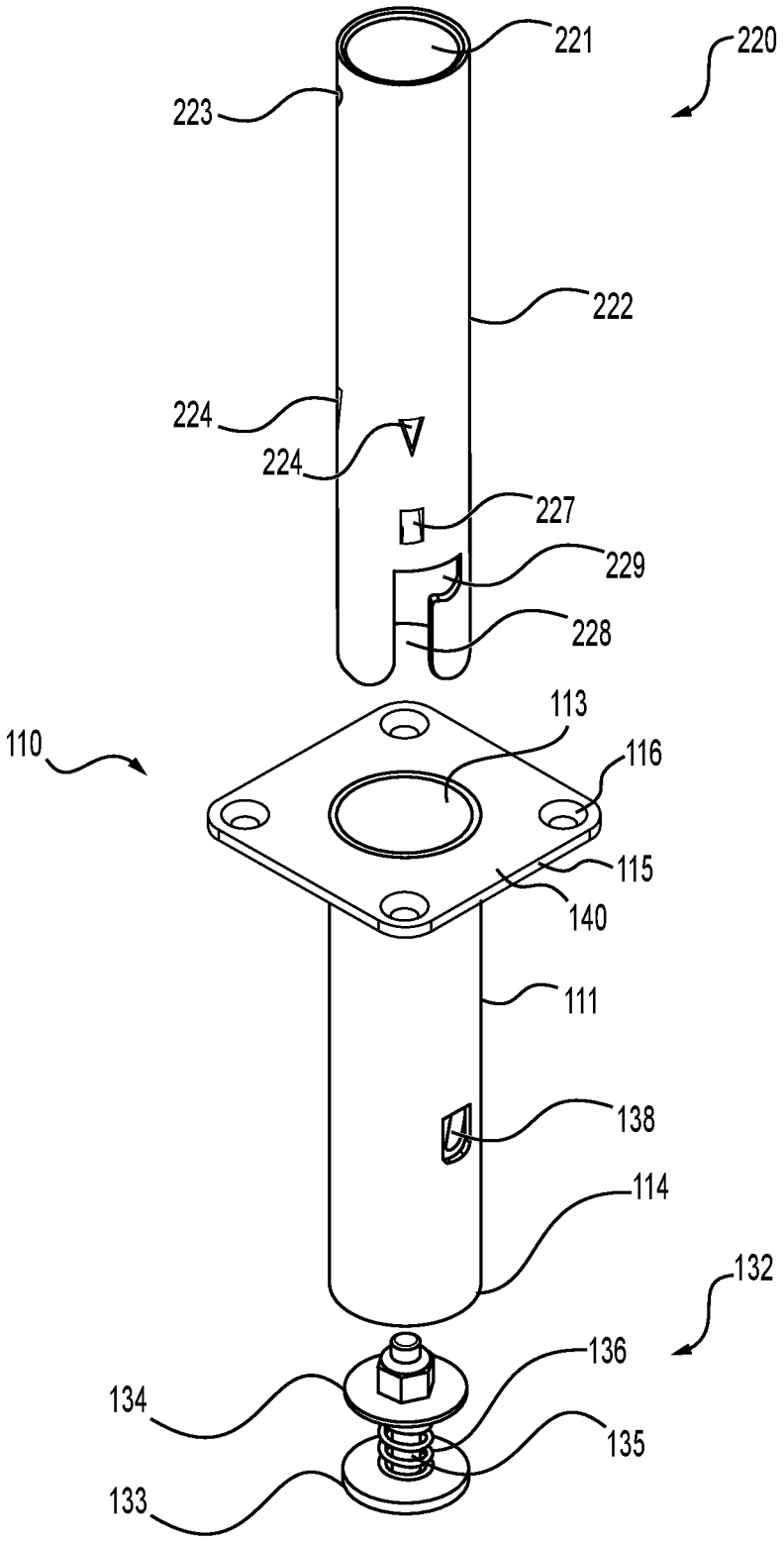
FIG. 12 presents an exploded perspective view of a mount assembly and an adapter assembly of a deck umbrella support system, in accordance with yet another embodiment of the present invention.

FIG. 12 shows an exploded perspective view of an embodiment of the umbrella support system of the present invention which includes an adapter tube 222 of the adapter assembly 220. The adapter tube 222 may be a tube having a hollow interior and is configured to receive at least a portion of the umbrella pole at a top end thereof through an umbrella receiving aperture 221 and to insert a lower portion thereof into the mount aperture 113 of the mount tube 111.

At a lower end of the adapter tube 222, a locking channel 228, 229 including a locking protrusion release channel 228 and a locking protrusion retention channel 229 is provided.

As described above in connection with other embodiments of the present invention, the locking channel 228, 229 engages with the locking protrusion 138 of the mount tube 111 with the aid of the locking unit 132 of the locking assembly 130 to secure the adapter tube 222 in the mount tube 111 in a locking orientation. The locking protrusion retention channel 229 is in communication with the locking protrusion release channel 228, and the locking protrusion retention channel 229 is disposed to be substantially perpendicular to the locking protrusion release channel 228. Further, the locking protrusion release channel 228 is substantially parallel to an axial direction of the adapter tube 222, and the locking protrusion retention channel 229 is configured to retain the locking protrusion 138 in the locking orientation.

As shown in FIG. 12, at a position above a height of the locking channel 228, 229, a stopper member 227 is disposed on the adapter tube 222 which protrudes inwards toward an interior of the adapter tube 222. The stopper member 227 is configured to support a bottom end portion of the umbrella pole (not shown) to prevent further insertion of the umbrella pole into the adapter tube 222 such that the umbrella pole does not come in contact with the lower end of the mount tube 111 and the locking unit 132.

Further, the adapter tube 222 includes one or more securing members 224 disposed to protrude slightly inwards towards an interior of the adapter tube 222. Each of the securing members 224 has a securing end configured to engage a side surface of the umbrella pole inserted into the adapter tube 222, securing the umbrella pole in the adapter tube 222 and preventing the release of the umbrella pole from the adapter tube 222. The securing end of the securing members 224 may be formed in an acute angle shape—for example, the securing members 224 may have a shape of a triangle as shown in the embodiments of FIGS. 12, 14, 16, and 19. Furthermore, the umbrella pole may be further secured in the adapter tube 222 by one or more adjustable securement fasteners (not shown in FIG. 12), which may be inserted into one or more through-holes 223 disposed proximate to an upper end of the adapter tube 222.

The securing members 224 and the stopper member 227 may be tabs formed via a punch out through and into an interior portion of the adapter tube 222. For example, the securing members 224 may be formed by forming a plurality of slits on the adapter tube 222 in the desired location and shape of the securing members 224 and pressing the tabs created by the plurality of slits inwards towards the interior of the adapter tube 222. As will be appreciated, the securing members 224 and the stopper member 227 in accordance with the present invention may comprise any of a number of protrusion configurations which extend at least partially into the interior of the adapter tube 222. Further, securing members 224 and stopper member 227 in accordance with the present invention may be constructed of any of a variety of rigid materials which provide sufficient structural integrity to perform the respective required functions, including, but in no manner limited to, metals such as steel, stainless steel, iron, copper, aluminum, etc., metal alloys, as well as any of a variety of plastics, thermoplastics, fiberglass, graphite, or composite materials, once again, just to name a few.

Figure 13:
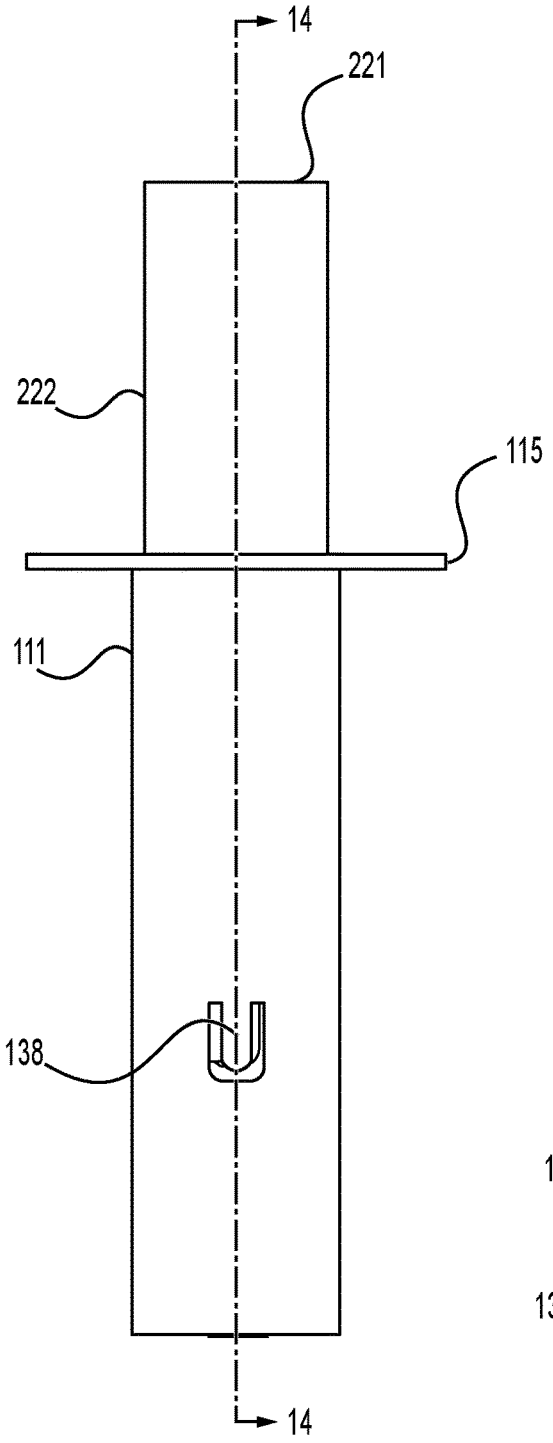
FIG. 13 presents an elevation view of the mount assembly and the adapter assembly of FIG. 12 disposed in an operative secured engagement.
Figure 14:
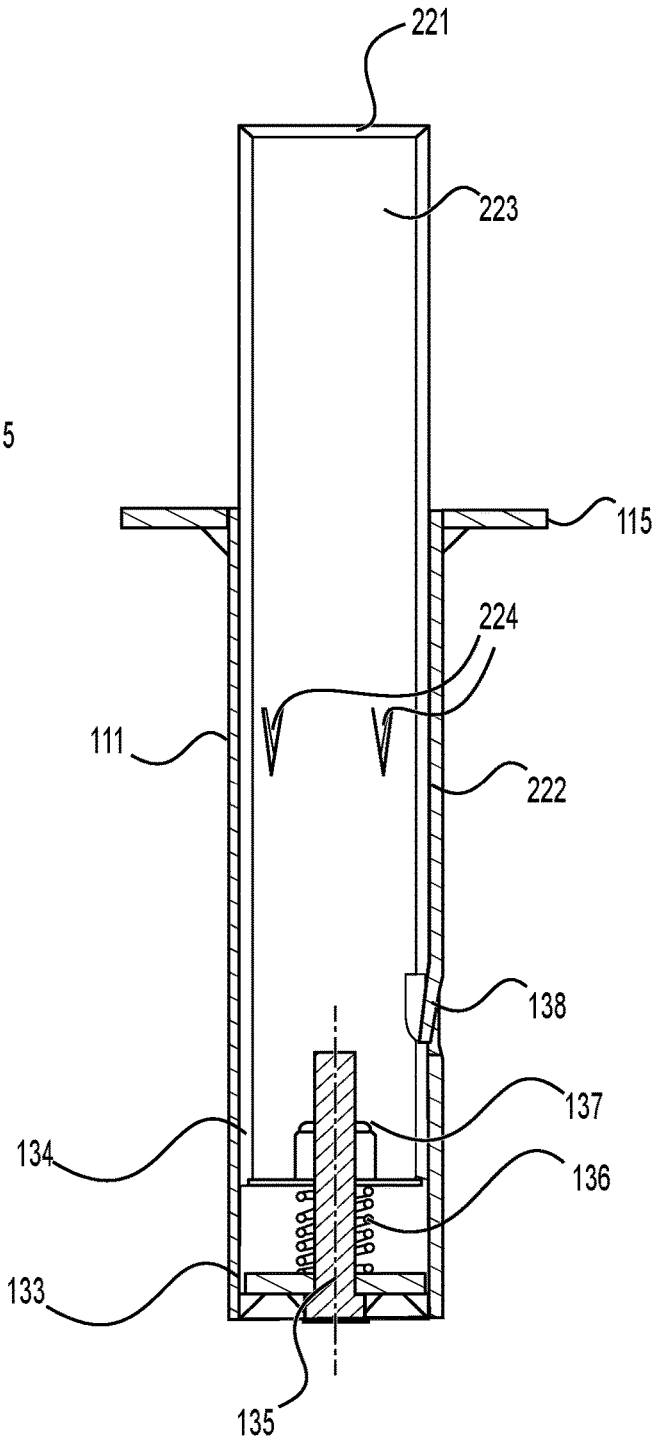
FIG. 14 presents a cross-sectional view of the mount assembly and the adapter assembly shown in FIG. 13, taken along the direction of 14-14.

Referring now to FIGS. 13 and 14, the umbrella support system of FIG. 12 is shown in a combined configuration in which the adapter tube 222 is inserted into the mount tube 111 and the locking protrusion 138 is in a locking orientation in the locking protrusion retention channel 229. FIG. 13 is an elevation view thereof and FIG. 14 is a cross-sectional view taken along the direction 14-14 in FIG. 13. In this embodiment, the mount plate 115 is disposed at an upper end of the mount tube 111 to be substantially perpendicular to an axial direction of the mount tube 111.

The adapter tube 222 is inserted through the mount aperture 113 and into a hollow interior of the mount tube 111, the locking channel 228, 229 of the adapter tube 222 operatively engages the movable member 134 of the locking assembly 130 and moves the movable member 134 towards the fixed member 133 upon application of a downward force to the adapter tube 222, which is greater than an upward force exerted by the biasing element 136, thereby disposing the biasing element 136 into a compressed configuration. As further shown in FIG. 14, the adapter tube 222 is inserted into the mount tube 111 until the locking protrusion 138 has passed through the locking protrusion release channel 228 and into the locking protrusion retention channel 229. By rotation of the adapter tube 222, in this instance in a clockwise direction, the locking protrusion 138 may be secured into the locking protrusion retention channel 229 in a locking orientation.

Figure 15:
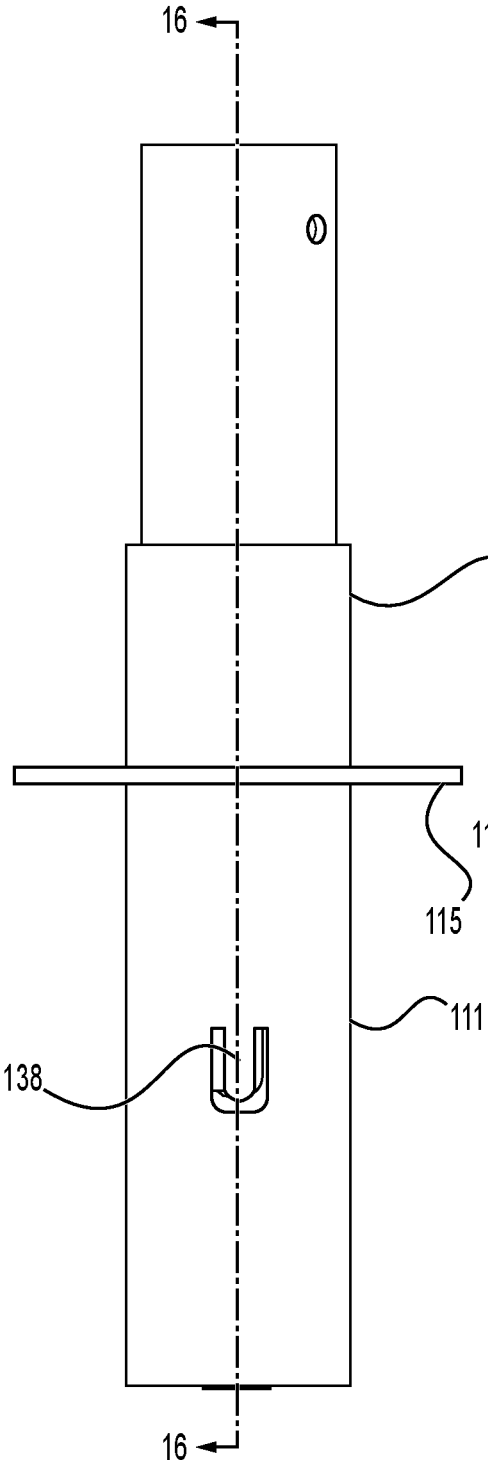
FIG. 15 presents an elevation view of a mount assembly and an adapter assembly disposed in an operative secured engagement, in accordance with yet another embodiment of the present invention.
Figure 16:
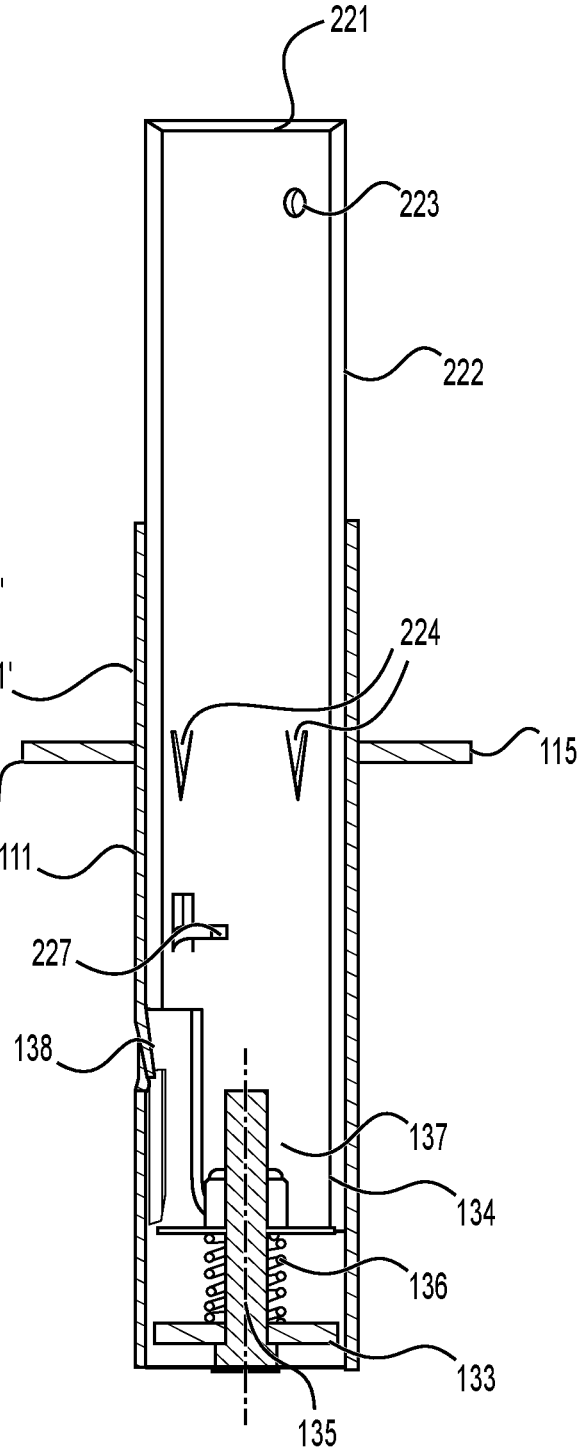
FIG. 16 presents a cross-sectional view of the mount assembly and the adapter assembly shown in FIG. 15, taken along the direction of 16-16.

Referring to FIGS. 15 and 16, an embodiment of the umbrella support system includes a mount plate 115 positioned at a different height position. In this embodiment, the mount plate 115 is disposed to be substantially perpendicular to an axial direction of the mount tube 111', and is disposed below the upper end of the mount tube 111' but above a height of the locking protrusion 138. As illustrated in FIGS. 15 and 16, the position of the mount plate 115 may be adjusted to be attached to the mount tube 111' at different height positions.

Figure 17:
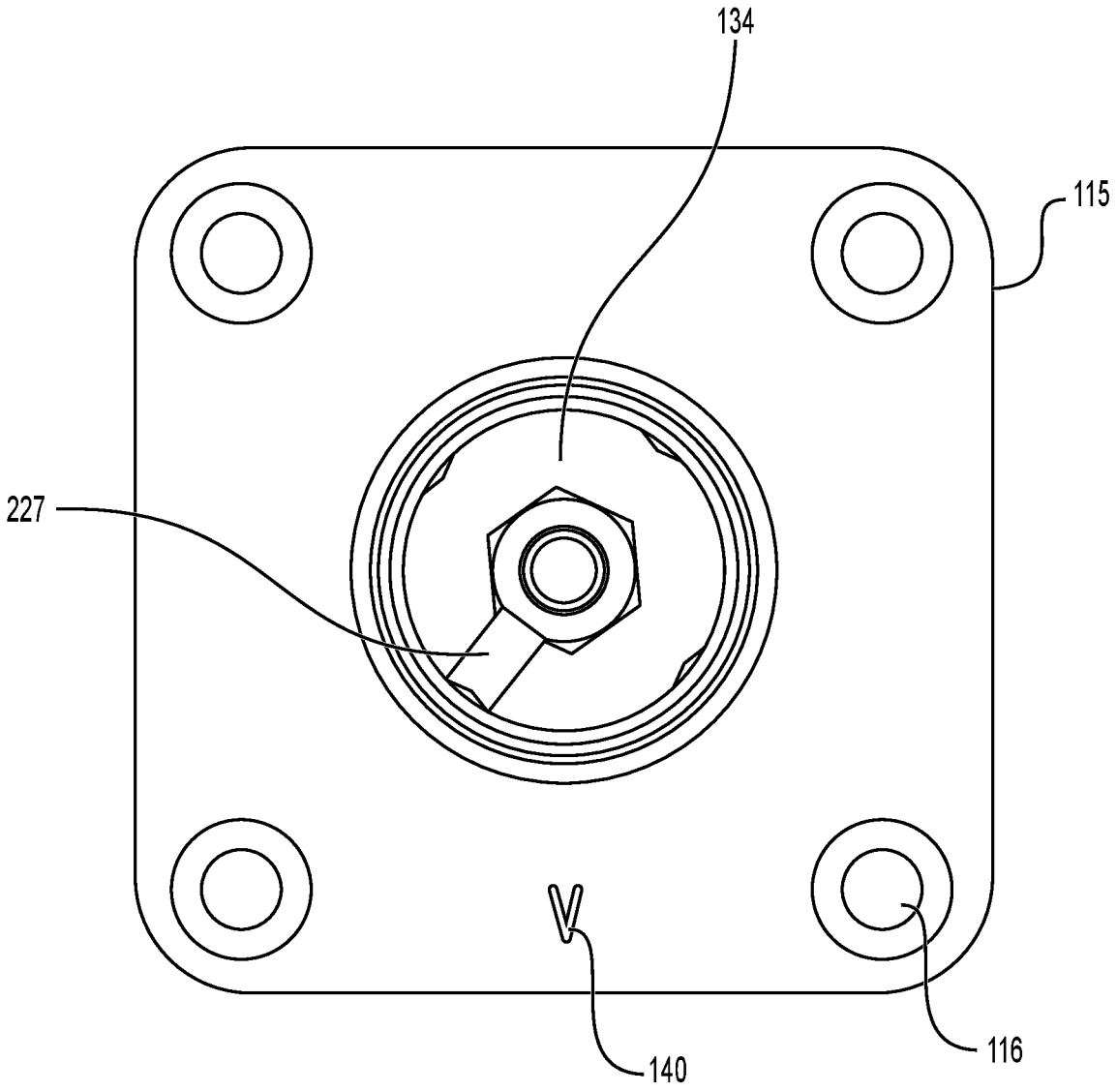
FIG. 17 presents a top plan view of the mount assembly and the adapter assembly of FIG. 12 disposed in an operative secured engagement.

Referring now to FIG. 17, a top plan view of an embodiment of the umbrella support system is shown in which the adapter tube 222 is combined into the mount assembly 110 and an umbrella pole is not received in the umbrella receiving aperture 221 of the adapter tube 222. In the mount plate 115 of the mount assembly 110, a locking position mark 140 is indicated at an upper surfaces of the mount plate 115. The locking position mark 140 is positioned at a location corresponding to a position of the locking protrusion 138 of the mount tube 111 such that a user inserting an adapter tube 122, 222 into the mount assembly 110 would be enabled to correctly align and insert the adapter tube 122, 222 without having to visually check the location of the locking protrusion 138. The locking position mark 140 may be applied on a mount plate 115 when the mount plate 115 would obstruct the user's vision from seeing the locking protrusion 138 when aligning the adapter tube 122, 222, e.g., when the mount plate 115 is disposed to be substantially perpendicular to an axial direction of the mount tube 111.

Figure 18:
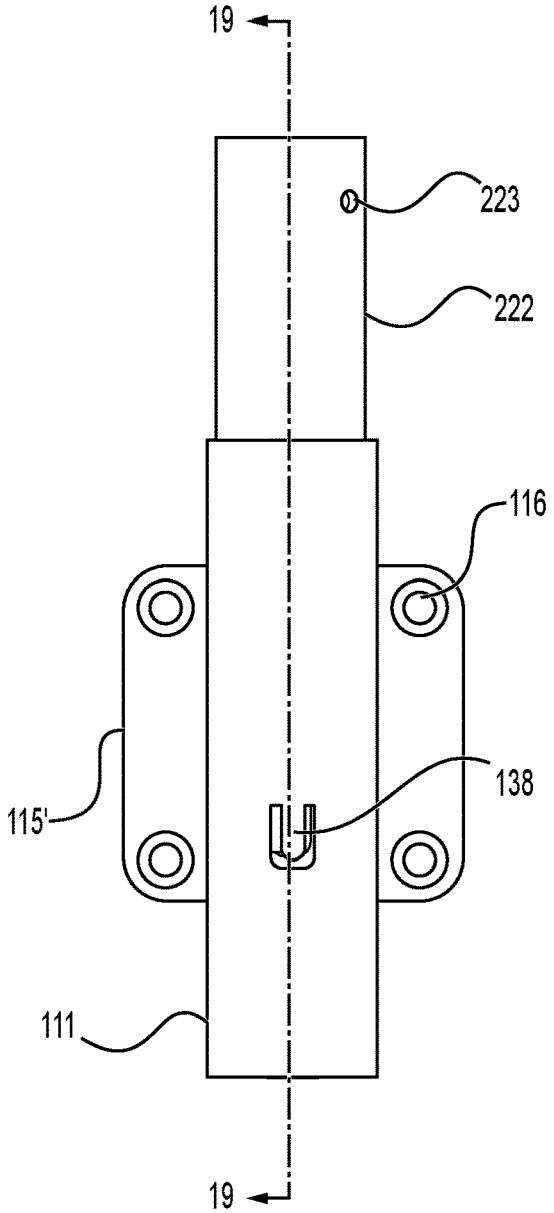
FIG. 18 presents a mount assembly and an adapter assembly disposed in an operative secured engagement, in accordance with yet another embodiment of the present invention.
Figure 19:
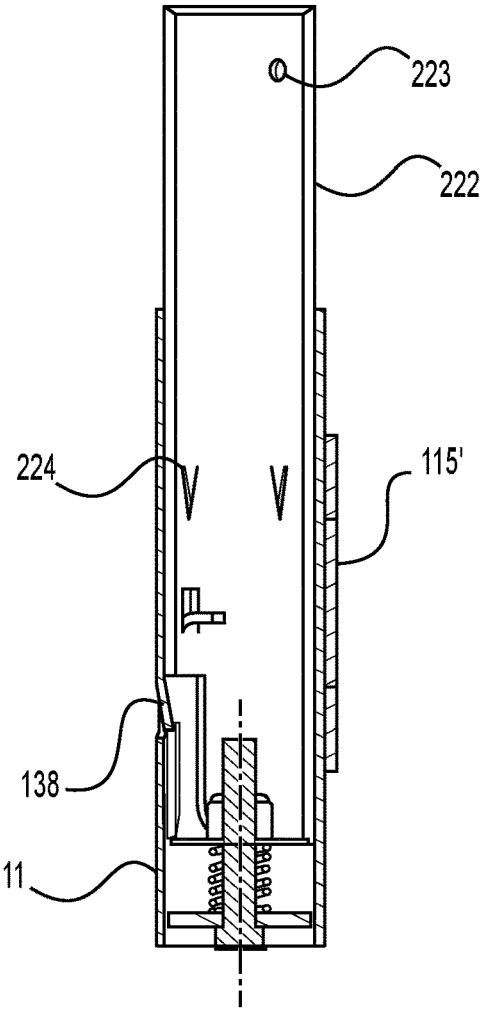
FIG. 19 presents a cross-sectional view of the mount assembly and the adapter assembly shown in FIG. 18, taken along the direction of 19-19.
Figure 20:
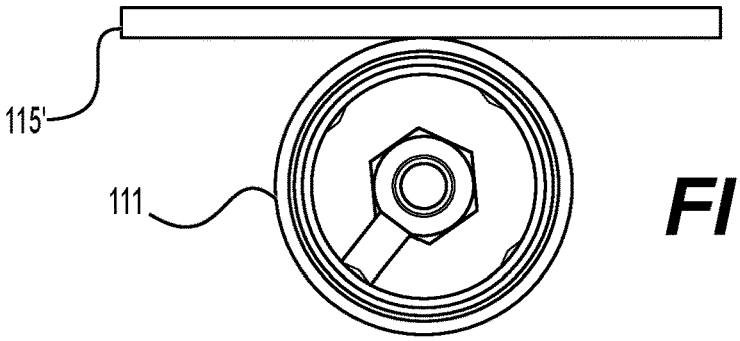
FIG. 20 presents a top plan view of the mount assembly and the adapter assembly of FIG. 19 disposed in an operative secured engagement.

In an embodiment of the present invention in which the mount plate 115' is disposed to be substantially parallel to an axial direction of the mount tube 111, such as in the embodiment shown in FIGS. 18-20, a locking position mark 140 is not necessary because the user's vision to see the locking protrusion 138 is not obstructed by the mount plate 115' when inserting the adapter tube 222 into the mount tube 111. FIGS. 18-20 illustrate an elevation view, a cross-sectional view taken along direction 19-19 of FIG. 18, and a top plan view of such embodiment, respectively.

Figure 21:
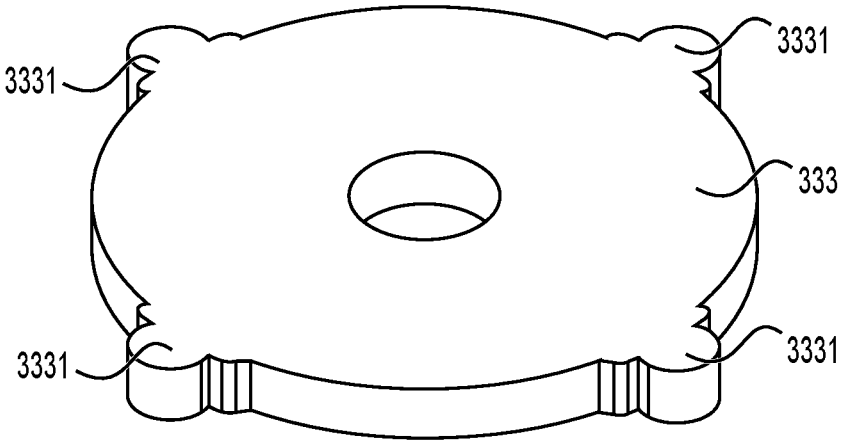
FIG. 21 presented a perspective view of a fixed member, in accordance with an embodiment of the present invention.
Figure 22:
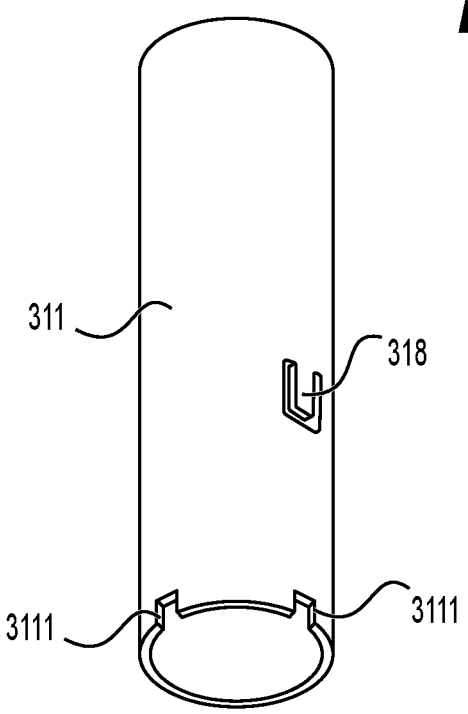
FIG. 22 presents a bottom perspective view of a mount tube of a mount assembly, in accordance with yet another embodiment of the present invention.
Figure 23:
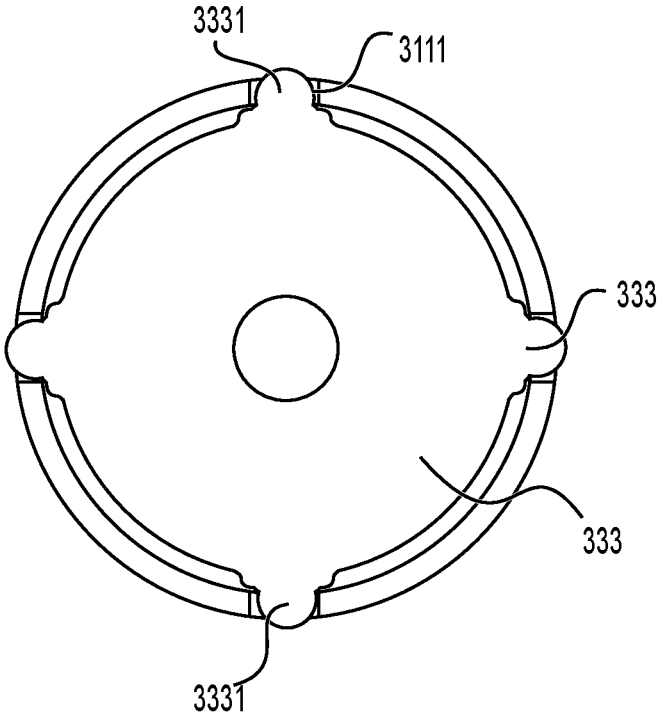
FIG. 23 presents a bottom plan view of the fixed member of FIG. 21 and the mount tube of FIG. 22 engaged with each other.

Now referring to FIG. 21-23, FIG. 21 illustrates an embodiment of a fixed member 333 of a locking unit 132, FIG. 22 illustrates an embodiment of a mount tube 311 for use with the fixed member 333, and FIG. 23 illustrates a bottom plan view of a mount tube 311 coupled to a fixed member 333. It would be appreciated that other elements of the locking unit 132 or the umbrella support system, e.g., mount plate 115, are not illustrated in FIGS. 21-23 for simplicity sake, but they may be assembled with the illustrated embodiments of the fixed member 333 and the mount tube 311 as shown and described above in the present application.

FIG. 21 illustrates an embodiment of a fixed member 333, the fixed member 333 having a circular or ring shape with a through-hole provided at a center thereof. The other elements of the locking unit 132, such as a connecting member 135, biasing element 136, and the movable member 134, may be assembled with the fixed member 333 via the center through-hole. The fixed member 333 includes a plurality of fixing protrusions 3331 disposed around a circumference of the fixed member 333, preferably at even intervals. In FIG. 21, the number of the fixing protrusions 3331 is four and a shape thereof is a semi-circle, but the number and shape of the fixing protrusions may be adjusted.

As illustrated in FIGS. 22 and 23, an embodiment of the mount tube 311 for use with the fixed member 333 of FIG. 21 includes a locking protrusion 318 and a plurality of fixing grooves 3111 disposed at a lower end of the mount tube 311. The plurality of fixing grooves 3111 of the mount tube 311 correspond in position to the plurality of fixing protrusions 3331 of the fixed member 333 such that the fixing protrusions 3331 are inserted into the fixing grooves 3111 and coupled thereto.

A coupling of the plurality of fixing protrusions 3331 and the plurality of fixing grooves 3111 facilitate easier manufacture of the umbrella support system by securing the fixed member 333 in position at a lower end of the mount tube 311. When coupled, the fixed member 333 does not slide into the interior of the mount tube 311 when assembling the locking unit 132 at the lower end of the mount tube 311. The mount tube 311 and the fixed member 333 may be constructed independently and thereafter secured to one another such as by welding, soldering, adhesives, etc., and thereafter, the other elements of the locking unit 132 and the mount plate 115 may be further assembled with the fixed member 333 and the mount tube 311, respectively.

Since many modifications, variations, and changes in detail can be made to the described embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. An umbrella support system to securely retain an umbrella canopy attached to an umbrella pole on a deck or an underlying substrate, the system comprising:

a mount assembly comprising a mount tube and a mount plate attached to the mount tube, the mount tube having a mount aperture disposed at an upper end thereof and an at least partially hollow interior, wherein the mount plate is configured to secure the umbrella support system to the deck or the underlying substrate;

an adapter assembly comprising an adapter tube having an at least partially hollow interior, wherein the adapter tube is configured to receive at least a portion of the umbrella pole to the at least partially hollow interior of the adapter tube and at least a portion of the adapter tube is configured to be inserted into the mount aperture of the mount tube; and a locking assembly disposed proximate to a lower end of the mount tube and configured to secure the adapter tube in the mount tube in a locking orientation, wherein the locking assembly comprises:

a fixed plate fixed to the lower end of the mount tube;

a movable plate;

a connecting rod connecting the fixed plate and the movable plate; and a spring disposed between the fixed plate and the movable plate and disposed about the connecting rod.

2. The umbrella support system of claim 1, wherein the mount tube comprises a locking protrusion disposed on the at least partially hollow interior of the mount tube and protruding inwards, and wherein the adapter tube comprises a locking channel disposed at a lower end thereof and configured to allow the locking protrusion to move therethrough in and out of the locking orientation.

3. The umbrella support system of claim 2, wherein the locking channel comprises a locking protrusion release channel and a locking protrusion retention channel in communication with the locking protrusion release channel, and wherein the locking protrusion retention channel is disposed to be substantially perpendicular to the locking protrusion release channel, the locking protrusion release channel is substantially parallel to an axial direction of the adapter tube, and the locking protrusion retention channel is configured to retain the locking protrusion in the locking orientation.

4. The umbrella support system of claim 3, wherein the locking protrusion retention channel comprises:

an open end communicating with the locking protrusion release channel and configured to receive the locking protrusion; and a closed end communicating with the open end and retaining the locking protrusion in the locking orientation.

5. The umbrella support system of claim 3, wherein, when the locking assembly secures the adapter tube in the mount tube in the locking orientation and the locking protrusion is retained in the locking protrusion retention channel, the spring is in a compressed position and a distance between the fixed plate and the movable plate is decreased.

6. The umbrella support system of claim 3, wherein the adapter tube comprises:

an open upper portion configured to receive the at least a portion of the umbrella pole; and a lower portion attached to the open upper portion and configured to be inserted into the mount aperture of the mount tube, wherein the locking channel is disposed proximate to a lower end of the lower portion of the adapter tube, and wherein the adapter assembly further comprises one or more adjustable securement fasteners couplable to the open upper portion of the adapter tube and configured to secure the umbrella pole in the open upper portion.

7. The umbrella support system of claim 6, wherein the adapter tube further comprises a shoulder disposed at an interface between the open upper portion and the lower portion of the adapter tube, and wherein the shoulder abuts against the mount plate of the mount assembly when the lower portion of the adapter tube is inserted into the mount tube and the locking protrusion is disposed in the locking protrusion retention channel.

8. The umbrella support system of claim 1, wherein the mount assembly further comprises a plurality of reinforcement bars attached along opposite sides of the mount tube.

9. The umbrella support system of claim 2, wherein the adapter tube comprises a stopper tab disposed on the at least partially hollow interior thereof above the locking channel and protruding inwards, and wherein the stopper tab is configured to engage a bottom end portion of the umbrella pole to prevent further insertion of the umbrella pole into the adapter tube.

10. The umbrella support system of claim 2, wherein the mount plate is attached to the mount tube to be substantially perpendicular to an axial direction of the mount tube.

11. The umbrella support system of claim 10, wherein the mount plate is disposed at the upper end of the mount tube or at a height between the upper end of the mount tube and the locking protrusion.

12. The umbrella support system of claim 1, wherein the mount plate is attached to the mount tube to be substantially parallel to an axial direction of the mount tube.

13. The umbrella support system of claim 3, wherein the mount tube comprises a plurality of fixing grooves disposed at the lower end thereof, wherein the fixed plate comprises a plurality of fixing protrusions corresponding to the plurality of fixing grooves of the mount tube, and wherein the plurality of fixing protrusions are fixedly coupled to the plurality of fixing grooves to prevent the fixed plate from entering the at least partially hollow interior of the mount tube.

14. An umbrella support system to securely retain an umbrella canopy attached to an umbrella pole on a deck or an underlying substrate, the system comprising:

a mount assembly comprising a mount tube and a mount plate attached to the mount tube, the mount tube having a mount aperture disposed at an upper end thereof and an at least partially hollow interior, wherein the mount plate is configured to secure the umbrella support system to the deck or the underlying substrate;

an adapter assembly comprising an adapter tube having an at least partially hollow interior, wherein the adapter tube is configured to receive at least a portion of the umbrella pole to the at least partially hollow interior of the adapter tube and at least a portion of the adapter tube is configured to be inserted into the mount aperture of the mount tube; and a lock disposed proximate to a lower end of the mount tube and configured to secure the adapter tube in the mount tube in a locking orientation, wherein the mount tube comprises a locking protrusion disposed on the at least partially hollow interior of the mount tube and protruding inwards, and wherein the adapter tube comprises a locking channel disposed at a lower end thereof and configured to allow the locking protrusion to move therethrough in and out of the locking orientation wherein the adapter tube comprises a stopper tab disposed on the at least partially hollow interior thereof above the locking channel and protruding inwards, and wherein the stopper tab is configured to engage a bottom end portion of the umbrella pole to prevent further insertion of the umbrella pole into the adapter tube, wherein the adapter tube further comprises one or more securing tabs disposed on the at least partially hollow interior thereof above the stopper tab and protruding inwards, and wherein each of the one or more securing tabs has a securing end configured to engage the umbrella pole and secure the umbrella pole in the adapter tube.

15. An umbrella support system to securely retain an umbrella canopy attached to an umbrella pole on a deck or an underlying substrate, the system comprising:

a mount assembly comprising a mount tube and a mount plate attached to the mount tube, the mount tube having a mount aperture disposed at an upper end thereof and an at least partially hollow interior, wherein the mount plate is configured to secure the umbrella support system to the deck or the underlying substrate;

an adapter assembly comprising an adapter tube having an at least partially hollow interior, wherein the adapter tube is configured to receive at least a portion of the umbrella pole to the at least partially hollow interior of the adapter tube and at least a portion of the adapter tube is configured to be inserted into the mount aperture of the mount tube; and a lock disposed proximate to a lower end of the mount tube and configured to secure the adapter tube in the mount tube in a locking orientation, wherein the mount tube comprises a locking protrusion disposed on the at least partially hollow interior of the mount tube and protruding inwards, wherein the adapter tube comprises a locking channel disposed at a lower end thereof and configured to allow the locking protrusion to move therethrough in and out of the locking orientation, wherein the mount plate is attached to the mount tube to be substantially perpendicular to an axial direction of the mount tube, and wherein the mount plate includes a locking position mark disposed at an upper surface thereof at a location corresponding to a position of the locking protrusion of the mount tube.

16. A mount assembly for an umbrella support system for securely retaining an umbrella canopy attached to an umbrella pole on a deck or an underlying substrate, the mount assembly comprising:

a mount tube having a mount aperture disposed at an upper end thereof, a plurality of fixing grooves disposed at a lower end thereof, and an at least partially hollow interior; and a mount plate attached to the mount tube and configured to secure the umbrella support system to the deck or the underlying substrate; and a locking assembly disposed proximate to a lower end of the mount tube, wherein the locking assembly comprises:

a fixed plate comprising a plurality of fixing protrusions corresponding to the plurality of fixing grooves of the mount tube, wherein the fixed plate is fixed to the lower end of the mount tube via the plurality of fixing protrusions and the plurality of fixing grooves;

a movable plate;

a connecting rod connecting the fixed plate and the movable plate; and a spring disposed between the fixed plate and the movable plate.

17. An adapter tube for an umbrella support system for securely retaining an umbrella canopy attached to an umbrella pole on a deck or an underlying substrate, the adapter tube having an at least partially hollow interior and configured to receive at least a portion of the umbrella pole, wherein at least a portion of the adapter tube is configured to be inserted into a mount assembly of the umbrella support system having a locking protrusion, the adapter tube comprising:

a locking channel disposed at a lower end of the adapter tube and configured to allow the locking protrusion of the mount assembly to move therethrough in and out of a locking orientation;

a stopper tab disposed on the at least partially hollow interior of the adapter tube above the locking channel and protruding inwards, wherein the stopper tab is configured to engage a bottom end portion of the umbrella pole to prevent further insertion of the umbrella pole into the adapter tube; and one or more securing tabs disposed on the at least partially hollow interior of the adapter tube above the stopper tab and protruding inwards, wherein the one or more securing tabs have a sharp securing end configured to engage the umbrella pole and secure the umbrella pole in the adapter tube, wherein the locking channel comprises a locking protrusion release channel and a locking protrusion retention channel in communication with the locking protrusion release channel, and wherein the locking protrusion retention channel is disposed to be substantially perpendicular to the locking protrusion release channel, the locking protrusion release channel is substantially parallel to an axial direction of the adapter tube, and the locking protrusion retention channel is configured to retain the locking protrusion in the locking orientation.

18. The adapter tube of claim 17, wherein the locking protrusion retention channel comprises:

an open end communicating with the locking protrusion release channel and configured to receive the locking protrusion; and a closed end communicating with the open end and retaining the locking protrusion in the locking orientation.

* * * * *